US006371199B1

(12) United States Patent
Gebhart

(10) Patent No.: US 6,371,199 B1
(45) Date of Patent: Apr. 16, 2002

(54) NUCLEATE BOILING SURFACES FOR COOLING AND GAS GENERATION

(75) Inventor: Benjamin Gebhart, Bryn Mawr, PA (US)

(73) Assignee: The Trustees of the University of Pennsylvania, Philadelphia, PA (US)

( * ) Notice: Subject to any disclaimer, the term of this patent is extended or adjusted under 35 U.S.C. 154(b) by 0 days.

(21) Appl. No.: 08/485,161

(22) Filed: Jun. 7, 1995

Related U.S. Application Data

(63) Continuation of application No. 07/767,227, filed on Sep. 27, 1991, now abandoned, which is a continuation-in-part of application No. 07/529,787, filed on May 25, 1990, now abandoned, which is a continuation of application No. 07/409,980, filed on Sep. 18, 1989, now abandoned, which is a continuation of application No. 07/159,713, filed on Feb. 24, 1988, now abandoned.

(51) Int. Cl.[7] ..... F28F 13/18; F28F 3/12; F28F 3/04

(52) U.S. Cl. ..... 165/47; 165/133; 165/104.21; 165/911

(58) Field of Search ..... 165/133, 47, 104.21, 165/911

(56) References Cited

U.S. PATENT DOCUMENTS

| | | | | |
|---|---|---|---|---|
| 3,301,314 A | | 1/1967 | Gaertner | |
| 3,392,781 A | * | 7/1968 | Zuber et al. | 165/133 |
| 3,454,081 A | | 7/1969 | Kun et al. | |
| 3,521,705 A | * | 7/1970 | Beurtheret et al. | 165/133 |
| 3,523,577 A | | 8/1970 | Milton | |
| 3,684,007 A | * | 8/1972 | Ragi | 165/133 |
| 3,906,604 A | * | 9/1975 | Kakizaki et al. | 165/133 |
| 4,050,507 A | | 9/1977 | Chu et al. | |
| 4,159,739 A | * | 7/1979 | Brothers et al. | 165/133 |
| 4,211,276 A | * | 7/1980 | Itoh et al. | 165/133 |
| 4,258,783 A | | 3/1981 | Albertson et al. | |
| 4,360,058 A | * | 11/1982 | Muellejans | 165/133 |
| 4,474,231 A | * | 10/1984 | Staub et al. | 165/133 |
| 4,663,243 A | | 5/1987 | Czikk et al. | |
| 4,678,029 A | | 7/1987 | Sasaki et al. | |
| 4,715,433 A | | 12/1987 | Schwartz et al. | |

FOREIGN PATENT DOCUMENTS

| | | | | |
|---|---|---|---|---|
| CA | 709574 | * | 5/1965 | 165/133 |
| CH | 610395 | * | 4/1979 | 165/133 |
| GB | 387828 | * | 2/1933 | 165/133 |
| JP | 37693 | * | 2/1987 | 165/133 |

OTHER PUBLICATIONS

Miersch, E.F. "Natural LSI Process Step to Create Controllable Boiling Centers" IBM Tech Disc vol. 18 No. 2 Jul. 1975.*

Hesketh et al., "Organ Pipe Radiant Modes of Periodic Micromachined Silicon Surfaces", *Nature,* vol. 324, pp. 549–551 (1986).

(List continued on next page.)

*Primary Examiner*—John K. Ford
(74) *Attorney, Agent, or Firm*—Nath & Associates PLLC; Gary M. Nath; Lee C. Heiman

(57) ABSTRACT

This invention provides heat transfer systems and methods of cooling surfaces and heating liquids which employ surfaces including a minimum density of discrete, nucleation sites having a conical cross-section tapering to a minimum predetermined depth. These surfaces are placed in contact with a refrigerant having a preselected boiling point so that the nucleation sites become largely flooded with the refrigerant. The nucleation sites permit nucleate boiling of a refrigerant without a temperature overshoot on the initial ascent. In more preferred variations of this invention, specific site spacing and geometries are employed to contain tiny bubble embryos, which minimize hysteresis and reversal of trend effects.

9 Claims, 22 Drawing Sheets

OTHER PUBLICATIONS

Gebhart, *Heat Transfer,* p. 371, McGraw–Hill, New York (1971).

Rohsenow, *Handbook of Heat Transfer,* pp. 13–28, McGraw–Hill, New York (1973).

Messina et al., "Effect of Precise Arrays of Pits on Nucleate Boiling", *Int. J. Heat Mass Transfer,* vol. 24, pp. 141–145 (1981).

Albertson et al., "Electroformed Boiling Surfaces" (undated).

Bergles et al., "Characteristcs of Nucleate Pool Boiling from Porous Metallic Coatings", *Journal of Heat Transfer,* vol. 104, pp. 279–285, May (1982).

Marto et al., "Pool Boiling Heat Transfer from Enhanced Surfaces to Dielectric Fluids", *Journal of Heat Transfer,* vol. 104, pp. 292–299, May (1982).

Gebhart et al., "Boiling Enhancement on Micro–configured Surfaces", *Inter. Comm. Heat Mass Transfer,* vol. 15, No. 1, pp. 141–149, Mar.–Apr. (1988).

Nakayama et al., "Effects of Pore Diameters and System Pressure on Saturated Pool Nucleate", *Journal of Heat Transfer,* vol. 104, pp. 286–290, May (1982).

Anderson et al., "Microelectronic Cooling by Enhanced Pool Boiling of a Dielectric Fluorocarbon Liquid", *Journal of Heat Transfer,* vol. III, pp. 752–759 (1988).

Miller, "Effects of Boiling History on a Micro–Configured Surface in a Dielectric Liquid" (not published).

Wright et al., "Enhanced Boiling on Microconfigured Surfaces", *Journal of Electronic Packaging,* vol. III, pp. 112–120 (1989).

Butler et al., "Improved Pool Boiling Heat Transfer to Helium from Treated Surfaces and its Application to Superconducting Magnets", *Inter J. Heat Mass Transfer,* vol. 43, pp. 105–111 (1970).

Hesketh, "The Emittance of Heavily Doped Micro–Configured Silicon Surfaces", Ph.D. Thesis (1987).

* cited by examiner

NUCLEATE BOILING SURFACES FOR COOLING AND GAS GENERATION

CROSS REFERENCE TO RELATED APPLICATION

The present application is a continuation of Ser. No. 07/767,227, filed Sep. 27, 1991 now abandoned which is a Continuation-in-Part of application Ser. No. 07/529,787, filed on May 25, 1990, which in turn is a Continuation of application Ser. No. 07/409,980, filed on Sep. 18, 1989, and now abandoned, which in turn is a Continuation of application Ser. No. 07/159,713, filed on Feb. 24, 1988, and now abandoned, all of which are hereby incorporated by reference in their entirety.

FIELD OF THE INVENTION

This invention relates to methods and systems for cooling surfaces and generating gases by nucleate boiling, and more particularly, to photo etched microconfigured surfaces disposed in contact with refrigerants.

BACKGROUND OF THE INVENTION

Various liquid emersion cooling systems have been provided in the past decade for cooling semi-conductors so as to retain their reliability, longevity, and speed. Boiling enhancement studies have often focused on increasing the overall active surface area by roughing, coating the surface in a random fashion, or by creating a known number of artificial nucleation sites.

Early heat transfer surfaces relied on the assumption that a rougher surface would have more locations that promote stable nucleation than a smoother surface. Although random roughness is easily created on most surfaces, a consistent performance over time required for use in electronic packages is not generally guaranteed by mere roughness alone. Moreover, such surfaces often contain voids containing trapped air which are likely to inhibit or cause irregular boiling.

Higher heat fluxes have been achieved using flow boiling or conduction cooling of silicon substrates by dielectric liquids. Although high heat fluxes are obtainable with such techniques, considerable plumbing and pumping power is required which may hinder the use of such systems in practical applications.

More recently, research has focused on studying arrays of artificially produced sites of known geometry and spacing. See U.S. Pat. No. 4,050,507 to Chu et al., herein incorporated by reference. Chu describes a method for customizing the heat transfer from walls of an electronic device, such as a chip or wafer, by laser-drilling apertures having a narrow opening which tapers to a larger oblong-shaped cavity. This nucleation cavity geometry relies upon the fact that the narrow opening prevents complete flooding of the cavity, so that vapors are trapped in the nucleation sites. Accordingly, it is stated that nucleate boiling can be initiated at approximately the same temperature each time without temperature overshoot.

Recent studies have indicated, however, that when dielectric coolants are employed, such as FREON®, these otherwise stable vapor-filled cavities become more readily flooded, since these fluids, unlike water, have a very small contact angle with the substrate surface, i.e., less than 5°. Chu attempts to get around this problem by artificially creating vapor bubbles in the cavities with a nucleation heater, but this adaptation requires additional space and expense, much like the earlier flow boiling techniques, and may not uniformly provide sufficient vapor to all sites to prevent flooding.

Accordingly, a need exists for nucleate boiling surfaces for cooling densely populated microelectronics circuits which are easy to make and implement. There is also a need for a boiling technique for removing large heat fluxes even at small superheats. There is a further need to provide a more efficient and compact system for generating gases from liquids, such as cryogenic liquids employed in industrial and medical applications.

SUMMARY OF THE INVENTION

This invention provides heat transfer and gas generation systems and methods of cooling surfaces and heating fluids which employ nucleate boiling. In the methods of this invention, a surface is prepared to obtain a predetermined minimum surface density of discrete nucleation sites having a conical cross-section tapering to at least a minimum predetermined depth. The surface is then immersed in a refrigerant having a preselected boiling point so that the nucleation sites become substantially flooded by the refrigerant. Finally, the surfaces are permitted to heat up to a temperature of at least the preselected boiling point, whereupon nucleate boiling initiates in the refrigerant without a temperature overshoot on the initial ascent.

This invention provides repeatable performance in water, FC-72, and liquid nitrogen. The spaced apart conical nucleation sites of this invention permit a large number of active nucleate boiling sites on the surface. These sites can be spaced randomly, uniformly, selectively, or in groups to permit uniform or tailored cooling of the surface. At greater heat fluxes, the active sites increase in number and become more closely spaced, yet efficient cooling or gas generation is maintained. Temperature hysteresis was found to depend on the spacing of the conical sites, and temperature overshoot, as well as the reversal of trend, was shown to be substantially eliminated by the surfaces of this invention.

Boiling heat transfer performance of regular microconfigured silicon surfaces in saturated water, FC-72, and in liquid nitrogen were conducted for testing this invention. The microconfigured surfaces were photo etched with inverted square pyramids 10 $\mu$m on a side and 7.1 $\mu$m deep. The inverted pyramids were repeated on 20, 40, and 60 $\mu$m centers. One set of experiments in FC-72 was also conducted with a microconfigured surface photo etched with 9.4 $\mu$m hexagonal dimples, 3.3 $\mu$m deep on 18.8 $\mu$m centers.

The number of nucleation sites in the microconfigured surfaces of this invention can be very large and all the features can include exactly the same geometry. This promotes repeatability of heat transfer performance, as well as accurate determinations of the transfer rates without statistical guesswork employed by the prior art. A characteristic dimension of the nucleation sites of this invention, the cavity diameter, is believed to be the size scale of a trapped vapor embryo in a cavity. This contributes to the improved heat transfer properties, despite the fact that the preferred refrigerants and microgeometries of this invention fail to satisfy the classical criteria for a stable vapor trapping conical cavity.

This invention is suitably applied to electronics cooling applications where the heat generated by densely packed chips is often detrimental to efficient operation of the circuitry. Computer components could be equipped with surfaces, such as on one side of the chip or on the outside surface of the encapsulation or package which contains the chip, containing selected arrays of microconfigured nucleation sites having different geometries and/or different spacings to provide uniform cooling of the component despite the non-uniform nature of the heat generated. The outside surface of these individual encapsulations or the exposed side of the chip could then be immersed in a suitable cooling module containing a sufficient quantity of refrigerant to effect cooling. Upon operating the computer, the component would heat up and nucleate boiling would occur in either a saturated or subcooled refrigerant. Bubbles would rise and would begin to dissipate their trapped heat into the surrounding liquid, resulting in a very efficient heat transfer from the component into the liquid. Since temperature overshoot is eliminated by this invention, the cooling of electronic components can be accomplished without the thermal shock normally associated with boiling mechanisms. This will enhance the reliability and extend the useful life of electronic components.

More efficient gas generating systems are also made possible by this invention, since the large heat transfer fluxes produced with the disclosed microconfigured surfaces can be harnessed to provide faster gas production with a smaller surface area. Such systems would be ideally suited for generating gas from cryogenic liquids, such as oxygen, nitrogen, and helium. The microconfigured surfaces of this invention could be heated above the vaporization temperature of these cryogenic fluids so as to rapidly produce a gaseous phase upon contact with the liquid. The resulting gas in pure or mixed form could be used in a variety of commercial applications, including, for example, respirators and industrial gas delivery systems.

BRIEF DESCRIPTION OF THE DRAWINGS

The accompanying drawings illustrate preferred embodiments of the invention as well as other information pertinent to the disclosure, and in which:

FIG. 16: is a graph depicting heat flux versus wall-superheat data for three separate experiments over four days for 10 μm inverted pyramids with 60 μm center spacing in FC-72. Also included are the results of Anderson and Mudawar (1989) and Marto and Lepere (1982);

DETAILED DESCRIPTION OF THE INVENTION

Methods of cooling surfaces, heating liquids, and generating gases by nucleate boiling are provided by this invention. These inventions take advantage of nucleation sites created, for example, by photo etching or equivalent processes, to create a minimum density of discrete, nucleation sites, each having a conical cross-section tapering to at least a minimum predetermined depth.

In more preferred embodiments of this invention, the conical cross-section of the nucleation sites includes a cavity cone angle which is greater than the liquid contact angle of the refrigerant employed for cooling. By "conical", it is meant that the sites have a cross-section opening up like a cone, for example, hexagonal dimples, pyramids, and trenches. Portions of an individual site may also be straight sided, but preferably are not "necked". In other words, the widest dimension of these conical cross-sections preferably is substantially commensurate with the exposed plane of the heat transfer surface, for example, a polished back surface of a chip or the top surface of a gas-generating heating element. Such sites also preferably have a minimum predetermined depth of at least about 1 $\mu$m, preferably greater than about 3 $\mu$m, and more preferably greater than about 5 $\mu$m. These sites can include an aspect ratio, height divided by diameter, "h/d", of at least about 0.1, preferably at least about 0.3, and most preferably at least about 0.5, with ideal conditions for heat transfer occurring at aspect ratios greater than 0.7.

As used herein, the term "refrigerant" refers to liquids and gases which are suitable for cooling applications. This group excludes water, but may include dielectric liquids, for example, FC-72, and cryogenic liquid air products, for example, liquid nitrogen, hydrogen, oxygen, helium, and other liquids and gases of importance. Some of these refrigerants are known to have a static liquid contact angle of less than about 100, with some being even less than about 5°. The terms "temperature overshoot", "hysteresis", and "reversal of trend" will be defined in the ensuing description.

Surface enhancement techniques of this invention can increase pool boiling heat transfer in saturated and subcooled water, dielectric liquids, and liquid nitrogen. Since the latent heat of water is 25 times larger than FC-72, a fluorocarbon dielectric liquid, and 10 times larger than liquid nitrogen, the heat removed for a fixed rate of vapor production will also be much higher. The surface tension of water is also about 7 times larger than either FC-72 or liquid nitrogen. This causes bubbles to be more spherical and perhaps to be more independent of neighboring bubbles. The critical heat flux in water is much higher. The conventional criterion for a stable vapor trapping conical cavity is shown in Equation 1. The criterion is in terms of the static liquid contact angle, $\gamma$, and the cavity cone angle, $\theta$, as follows:

$$\theta<\gamma<90° \quad (1)$$

Figure 5:
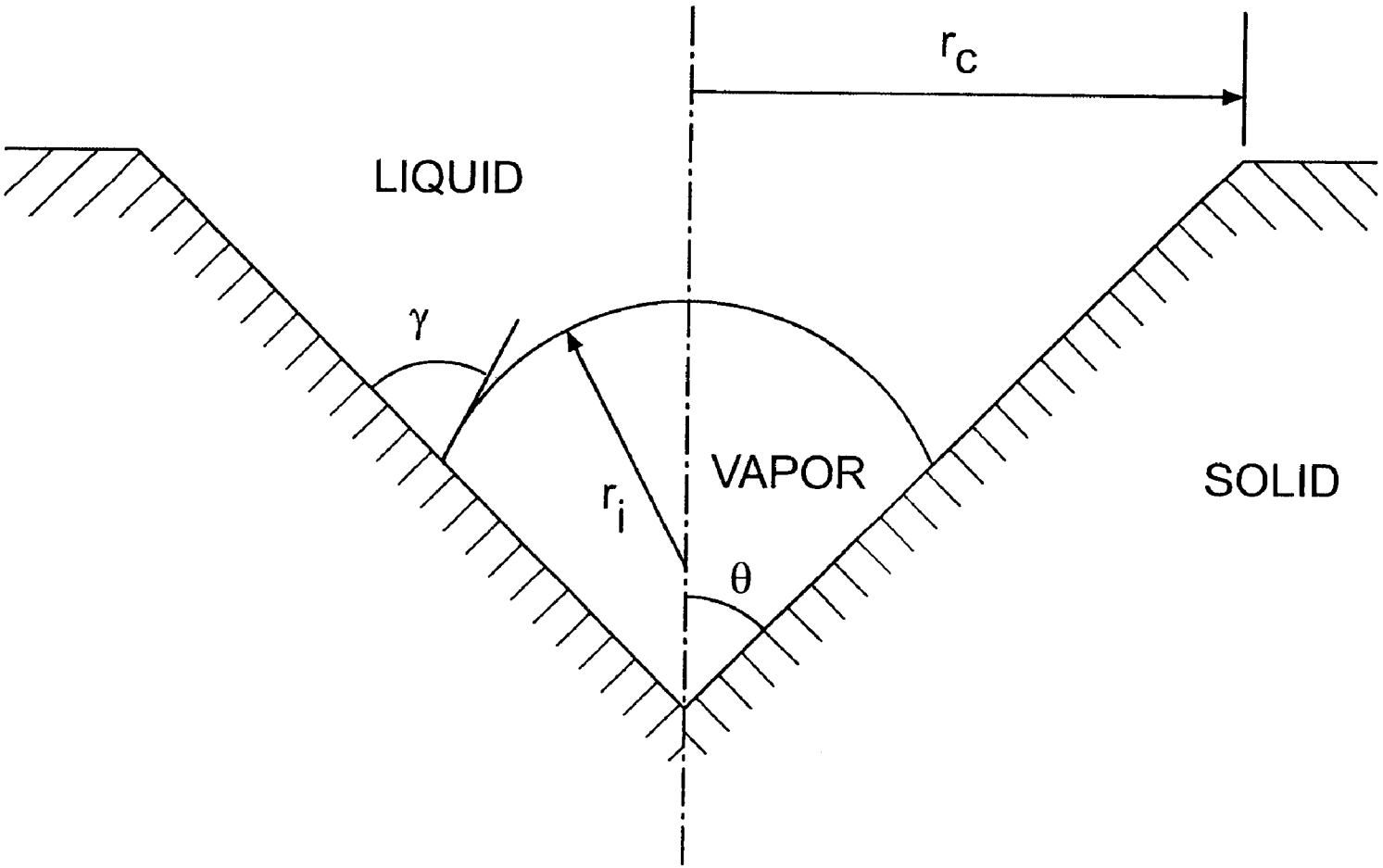
FIG. 5: is an illustration of an idealized vapor filled conical cavity.

The cavity geometry and liquid contact angle are shown in FIG. 5. When $\theta$ and $\gamma$ satisfy this condition, the incipient superheat is calculated from the Laplace and the Clausius-Clapeyron equations, to obtain:

$$\Delta t=2\sigma T_{sat}/(\rho_g h_{fg} r_{cav}) \quad (2)$$

where $\sigma$ is the surface tension, $T_{sat}$ is the remote fluid saturation temperature, $h_{fg}$ is the latent heat of vaporization, $\rho_g$ is the density of the vapor, and $r_{cav}$ is the radius of the nucleation site.

The criterion of Equation 1 is generally met in water because the contact angle is between 60 and 90° depending on surface conditions. For low contact angle liquids, e.g., $\gamma<5°$, Equation 1 will apply only for very steep walled conical cavities with aspect ratios, height divided by diameter, "h/d", greater than 10. Cavities with aspect ratios this large are generally not found in typical engineering surfaces.

No hysteresis, at the onset of boiling, is expected in water if the nucleation site is stable. As used herein, "hysteresis" is understood to be the excess wall-superheat temperature necessary to activate nucleation sites on the first ascent of the boiling curve, minus the wall-superheat on the first descent of the boiling curve.

Although very high heat fluxes may be dissipated into water, it is not likely to be a practical working fluid for the cooling of microelectronic devices. The saturation temperature of 100° C., at atmospheric pressure, is too high for the long term reliability of conventional electronic circuit elements. Also, the electrical resistance and purity of water are very difficult to maintain at a high level. There would also be solutal effects and the integrity of such a boiling surface may degrade over time. Performance with dielectric liquids, such as FC-72 or R-113, are preferred over water. They have high electrical resistance and low atmospheric pressure saturation temperatures. Perfluorohexanes, like FC-72, are preferred over Chloro-fluoro-carbons, like R-113, for environmental and health reasons.

Recent experimental demonstrations of high temperature superconductivity in liquid nitrogen is expected to have drastic effects on the speed and performance of electronic logic circuits. Superconductivity may even possibly be maintained at 77K, by direct liquid nitrogen evaporation. Accordingly, this coolant is a most interesting boiling media to be used in contact with the microconfigured surfaces of this invention.

Two problems observed in past studies with low contact angle dielectric liquids are the large temperature overshoot, before boiling initiation, and the unpredictability of the wall-superheat needed to initiate boiling. In order to determine the effectiveness in overcoming these prior art problems, tests were conducted using specially microconfigured silicon surfaces prepared by standard photolithographic processes.

Figure 1:
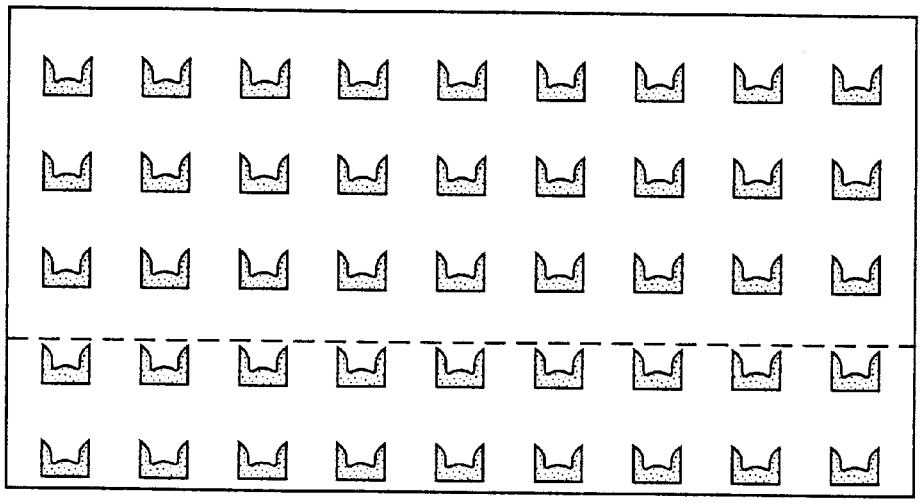
FIG. 1: is an illustration of a photomicrograph with side lighting of a surface containing 10 μm inverted pyramids, 7.1 μm deep on 20 μm centers.
Figure 2:
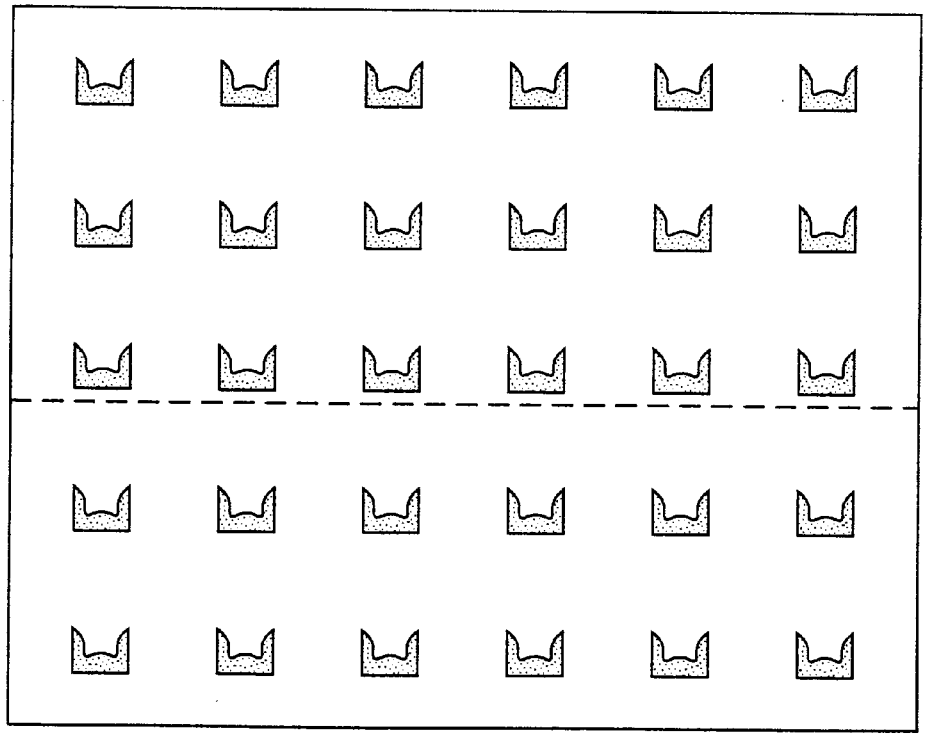
FIG. 2: is an illustration of a photomicrograph with side lighting of a surface containing 10 μm inverted pyramids, 7.1 μm deep on 40 μm centers.
Figure 3:
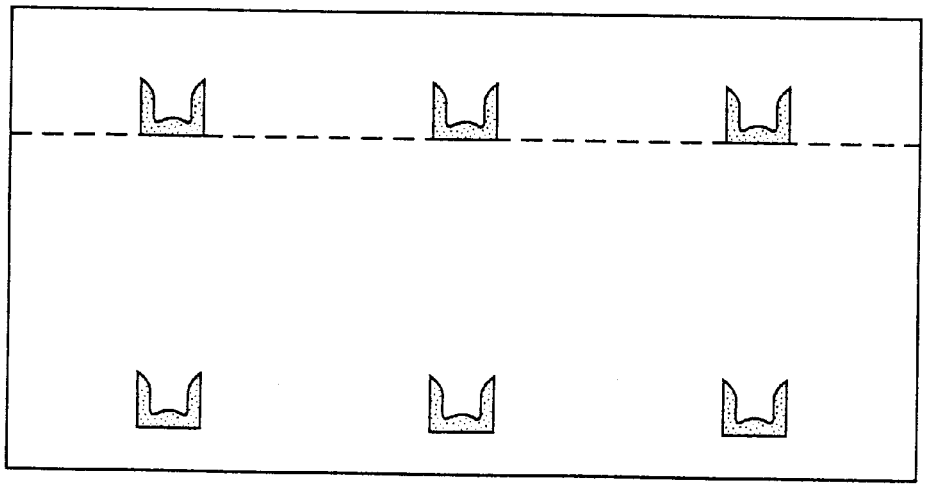
FIG. 3: is an illustration of a photomicrograph with side lighting of a surface containing 10 μm inverted pyramids, 7.1 μm deep on 60 μm centers.

The microconfigured surfaces used for the measurements reported herein were 1.27 cm×1.27 cm×0.04 cm p-type (110) oriented silicon chips. The boiling surface of the specimen was polished to the sub micron level and then using standard photolithography techniques, e.g., application of a photographic film, application of a 40% (w/v) solution of KOH at 52° C., followed by spin-coating with a phosphorus-based dopant and heating at 1,250° C. for 10 hours. This common chip manufacturing process was used to produce a series of specimens having special inverted square pyramids sites, 10 $\mu$m on a side and 7.1 $\mu$m deep. The inverted pyramids were repeated on 20, 40, and 60 $\mu$m centers, as shown in FIGS. 1–3. These spacings correspond to site densities of $2.5\times10^5$, $1.1\times10^5$, and $2.8\times10^4$ sites/cm$^2$, respectively. Alternatively, these microconfigured surfaces can be prepared with these or much higher site densities, for example, $1\times10^6$ to about $1\times10^{10}$, or above, by using other methods of microconfiguration, such as laser and x-ray techniques.

Figure 7:
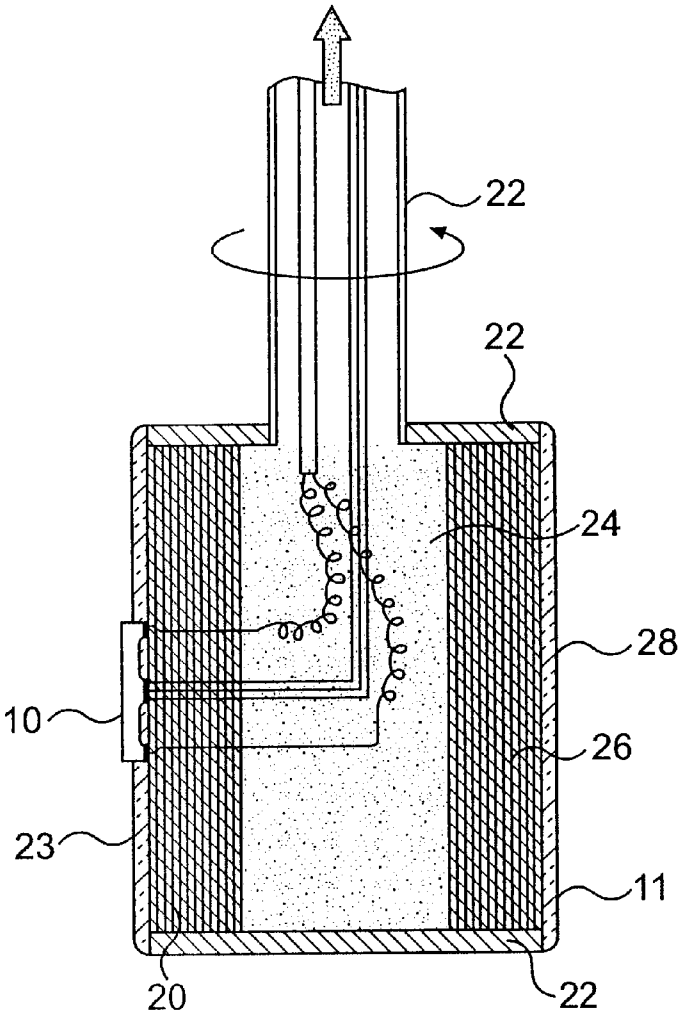
FIG. 7: is an illustration of an exemplary test module.
Figure 6:
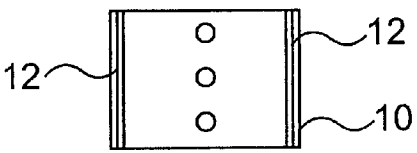
FIG. 6: is an illustration of an instrumented microconfigured silicon specimen for testing this invention.

As illustrated in FIGS. 6 and 7, the non-boiling back side of the chip 10 was sputter-coated with approximately an 800 A° layer of nichrome. Two 1 mm wide parallel gold film contacts 12 were then sputtered along the two vertical opposite edges. These gold contacts ensured good electrical contact with the power leads to produce a resistance heater. The resistance from one gold contact to another was 21 ohms. Three 40 AWG T-type thermocouples 18 were bonded with an electrically insulating epoxy at three back surface thermocouple locations 14 along the centerline of the chip 10 in a vertical array. Two 24 AWG insulated copper power leads 16 and two 40 AWG voltage taps 17 were tape soldered to each of the gold contacts. They supplied the required power and measured the voltage drop across the nichrome resistance heater, respectively.

The instrumented silicon chip 10 was center-mounted in the test module on a stack of five 5.08 cm diameter felt wafers. These five wafers were bonded together and sealed with Crest Crop. cryogenic adhesive 23. This layer is called the felt insert 20. Holes were drilled in the felt insert 20, in the proper locations, for the instrumentation wires. The felt insert 20 was then mounted inside a short stainless steel tube 22, with cryogenic adhesive, to create a liquid proof barrier. This stainless steel tube was 5.08 cm ID and 5.40 cm OD and 5.08 cm long. The instrumentation wires were fed from the ring to the laboratory through a thin-walled, 0.95 cm OD and 0.051 cm thick, stainless steel conduit 22. The conduit was welded perpendicular to the side wall of the 5.08 cm diameter short tube 22, 3.81 cm from the front face. Fiberglass insulation 24 was packed loosely in the remaining volume of the stainless steel short tube. Another felt insert 26 was epoxied with cryogenic adhesive 28, similar to the first felt insert, in the rear of the short tube 22. The instrumentation wires and back surface of the silicon specimen were then completely sealed from the liquid. The inside volume of the module was vented to ambient pressure via the vertical thin-walled tube 22. The size of the short tube 22, diameter of the power leads 16, and the resistance of the nichrome heater were chosen, based on an analysis, to minimize the spurious heat losses in tests in the three test fluids.

Detailed modeling studies of the convection and conduction losses in this module indicated the following choices: a specimen resistance of 21 ohms, 24 AWG power leads, and 6 cm of coiled wire inside the module, a module radius of 2.5cm, and a front-to-back thickness of 2.2 cm. This design results in a maximum of 10% losses as the worst case for the three test fluids. The worst case is FC-72 with a 1° C. wall-superheat and heat flux of 0.1 W/cm$^2$. The fabrication materials and procedure were chosen to be compatible with all of the test fluids.

Figure 4:
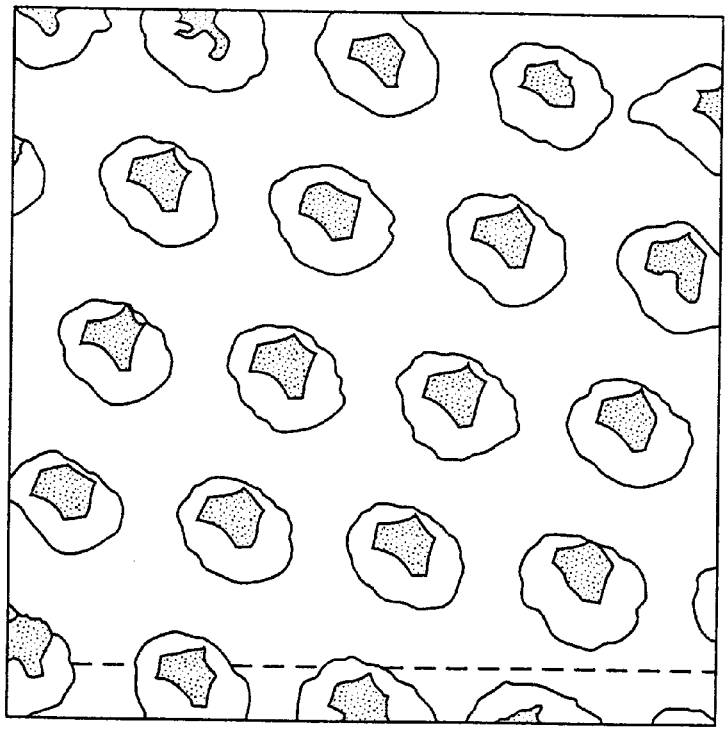
FIG. 4: is an illustration of a photomicrograph with side lighting of a surface containing 9.4 μm hexagonal dimples, 3.3 μm deep on 18.8 μm centers.
Figure 8B:
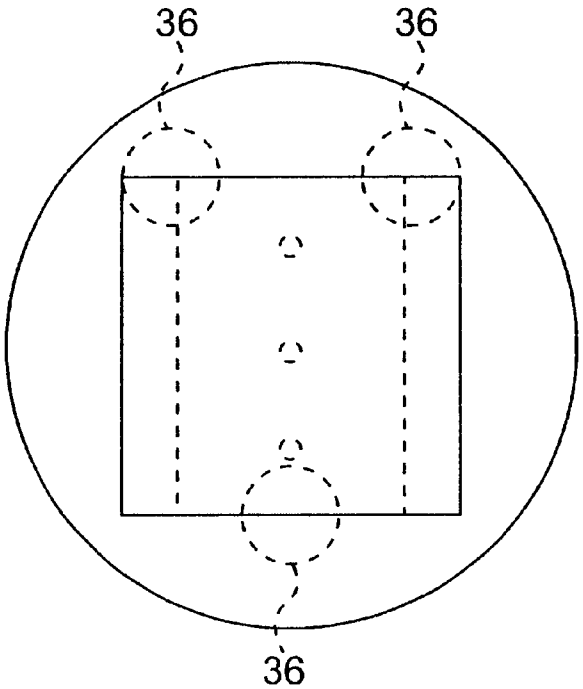
FIG. 8*b*: is a front elevation view of the sting of FIG. 8*a* for the 9.4 μm hexagonal dimple specimen.
Figure 8A:
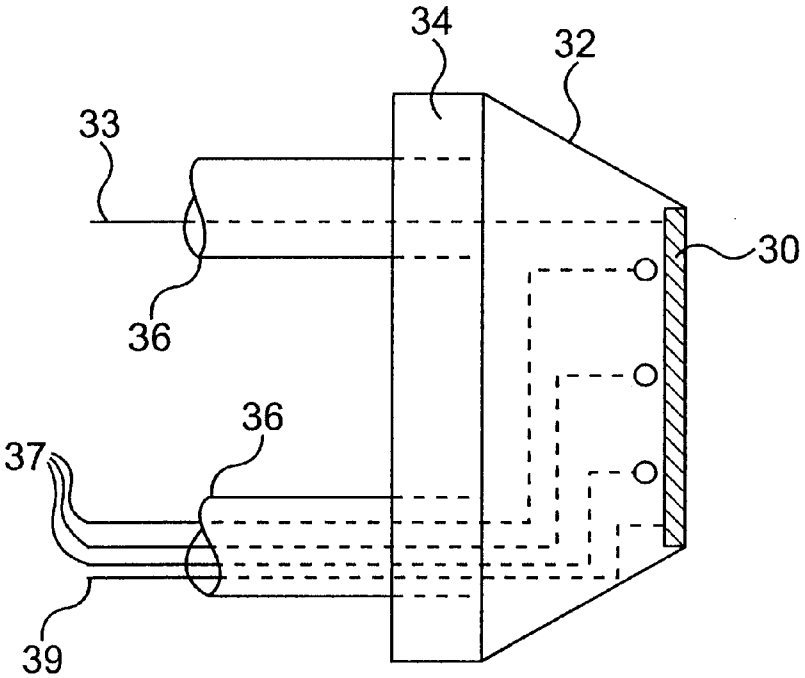
FIG. 8*a*: is a side elevation view of the sting used by Wright and Gebhart (1989) for the 9.4 μm hexagonal dimple specimen.

One set of experiments was conducted in FC-72, with a silicon surface photo etched with hexagonal dimples 9.4 $\mu$m from corner to corner, 3.3 $\mu$m deep, and 18.8 $\mu$m center to center spacing and a density of $2.5\times10^5$ sites/cm$^2$, per FIG. 4. The chip was 1.27 cm by 1.27 cm, p-type (110) oriented silicon. It was 300 $\mu$m thick and cut from Czochralski grown crystals. Each side was phosphorous doped about 10 $\mu$m deep to about $10^{20}$ per cm$^3$. The back side of the specimen 30 was instrumented in the same fashion as the previous specimen, as shown in FIGS. 8*a* and 8*b*. The specimen was mounted vertically on the module face, using an RTV silicon adhesive/sealant 32, which has good electrical and thermal insulating properties. The stainless steel sting 34 had three pass-throughs 36 for the power leads 33, thermocouple wires 37, and voltage taps 39.

Figure 9B:
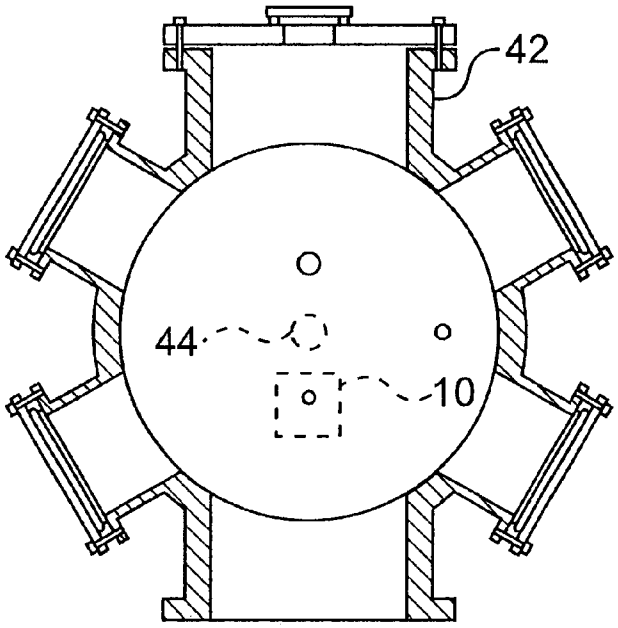
FIG. 9*b*: is a top elevation view of the stainless steel tank of FIG. 9*a* and associated elements used for the boiling heat transfer measurements in water and FC-72.
Figure 9A:
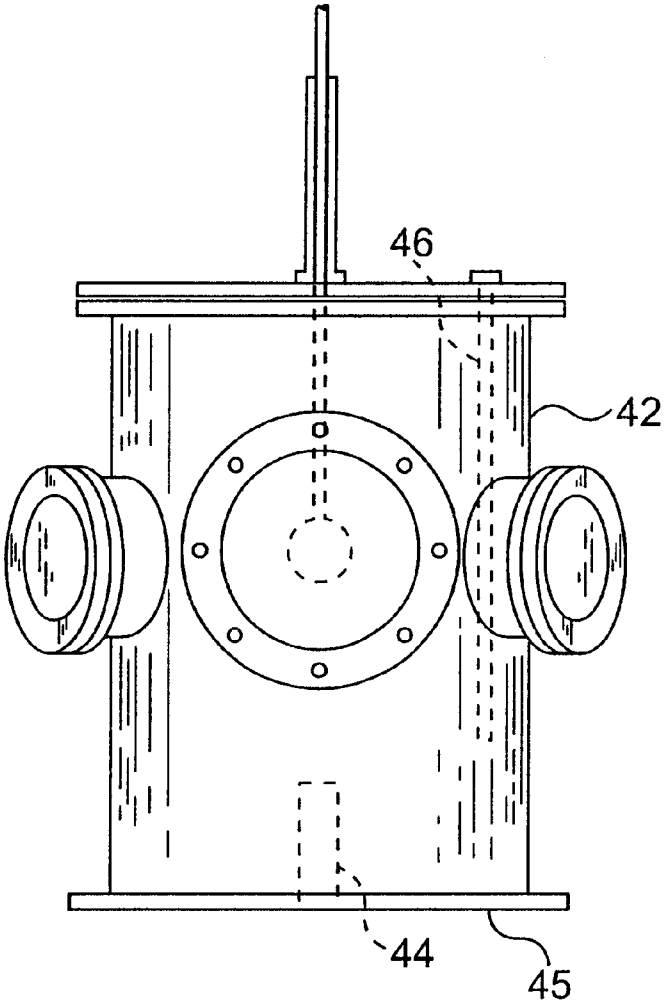
FIG. 9*a*: is a side elevation view of the stainless steel tank and associated elements used for the boiling heat transfer measurements in water and FC-72.

The water and FC-72 boiling experiments were conducted in an electrically grounded and thermally insulated stainless steel tank 42, 20 cm in diameter and 44 cm in height, as shown in FIGS. 9*a* and 9*b*. The module 11 for the 10 $\mu$m inverted pyramid surface was mounted from the center of the top lid with a stainless steel o-ring flange. A chilled water condenser kept the FC-72 or water liquid level constant during each experiment. The test fluids were maintained at the saturation temperature, 100° C. for water and 56° C. for FC-72, by a vertical immersion heater 44 protruding from the bottom plate 45 of the tank. Three T-type, 40AWG, thermocouples 46 were oriented in a vertical array in the tank to determine any appreciable fluid stratification. These thermocouples 46 were coated with a thin film of enamel to electrically insulate them from the high voltage heater behind the microconfigured surface. Before this was done, small voltage transients from the heat transfer surface, at high heat fluxes in water, compromised the accuracy of the stratification temperature measurements. This problem was not encountered in FC-72 because of its very high electrical resistance.

Measurements in liquid nitrogen were conducted in a 34 liter cryogenic dewar. The static holding time of this dewar is 18 weeks. This small heat leak did not cause appreciable unwanted natural convection during the experiment. The 20 cm long styrofoam cap of the dewar was drilled to accept the stainless steel module support from the stainless steel tank. No module modifications were required for experiments in different fluids.

Extreme care was taken to guarantee the purity of the test fluids. The water was deionized to greater than $10^6$ ohms/cm and changed after each set of experiments. The stainless steel tank was disassembled and cleaned frequently with a weak acid bath. Liquid nitrogen was added to the dewar when necessary to maintain a proper liquid level.

All tests were conducted at atmospheric pressure. Prior to tests in water and FC-72, the bulk fluid was boiled for at least two hours. The test surface, itself, was activated to approximately 60% of its critical heat flux for one hour. This procedure de-gassed the test fluid and possibly the nucleation sites on the microconfigured test surface. In liquid nitrogen only the test surface was activated since no immersion heater was necessary to maintain saturation conditions. The test surface was aligned vertically by centering the reflected diffraction pattern off of the microconfigurations from a horizontal Helium-Neon laser back onto the laser itself. Data acquisition and specimen electrical input were automated via a computer interface loop. One thermocouple on the back of the specimen was continuously monitored as a safety control to avoid the boiling crisis. When the surface temperature exceeded a preset limit, power to the test surface was terminated.

After each change in input power level to the test surface during experiments in water and FC-72, the surface temperature was allowed to reach a steady state value with the immersion heater on. At this time, data was taken, and the immersion heater was turned off until bubbles rising from the immersion heater ceased. This took approximately 3 minutes. Data was taken again. The bulk temperature decreased no more than 0.4° C. below the saturation temperature during each test. Stratified never exceeded 0.02° C./cm while the immersion heater was off, during a test. The immersion heater was turned on again when the power input level was changed. In liquid nitrogen, after a change in input power, the surface temperature reached a steady state. Then data was taken, and the power was changed. Bulk fluid stratification of up to 0.05° C./cm was measured in $LN_2$. Surface temperature measurements in all fluids agreed to within 0.3° C. of each other except at boiling initiation. Then only small portions of the surface were active. Thermocouple measurements disagreed with each other by less than about 1.2° C.

A one dimensional conduction calculation was used to determine the front surface temperature given the thermocouple measurements on the back surface. The thermal conductivity of silicon, for this calculation, was taken at the saturation temperature of water, FC-72, and $LN_2$ as 1.21, 1.56, and 9.50 W/cm° C. respectively. Given these high values, the temperature difference across the silicon layer, at the highest flux imposed during the measurements in water, FC-72, and $LN_2$ were 1.65, 0.41, and 0.07° C. respectively.

During early measurements in FC-72 with the 9.4 μm hexagonal dimple surface, the boiling curve was ascended, descended, and ascended again. In the later experiments with the 10 μm inverted pyramid features, the boiling curve was ascended and descended. Each experiment was repeated 24 hours to 48 hours later to verify the data.

Figure 10:
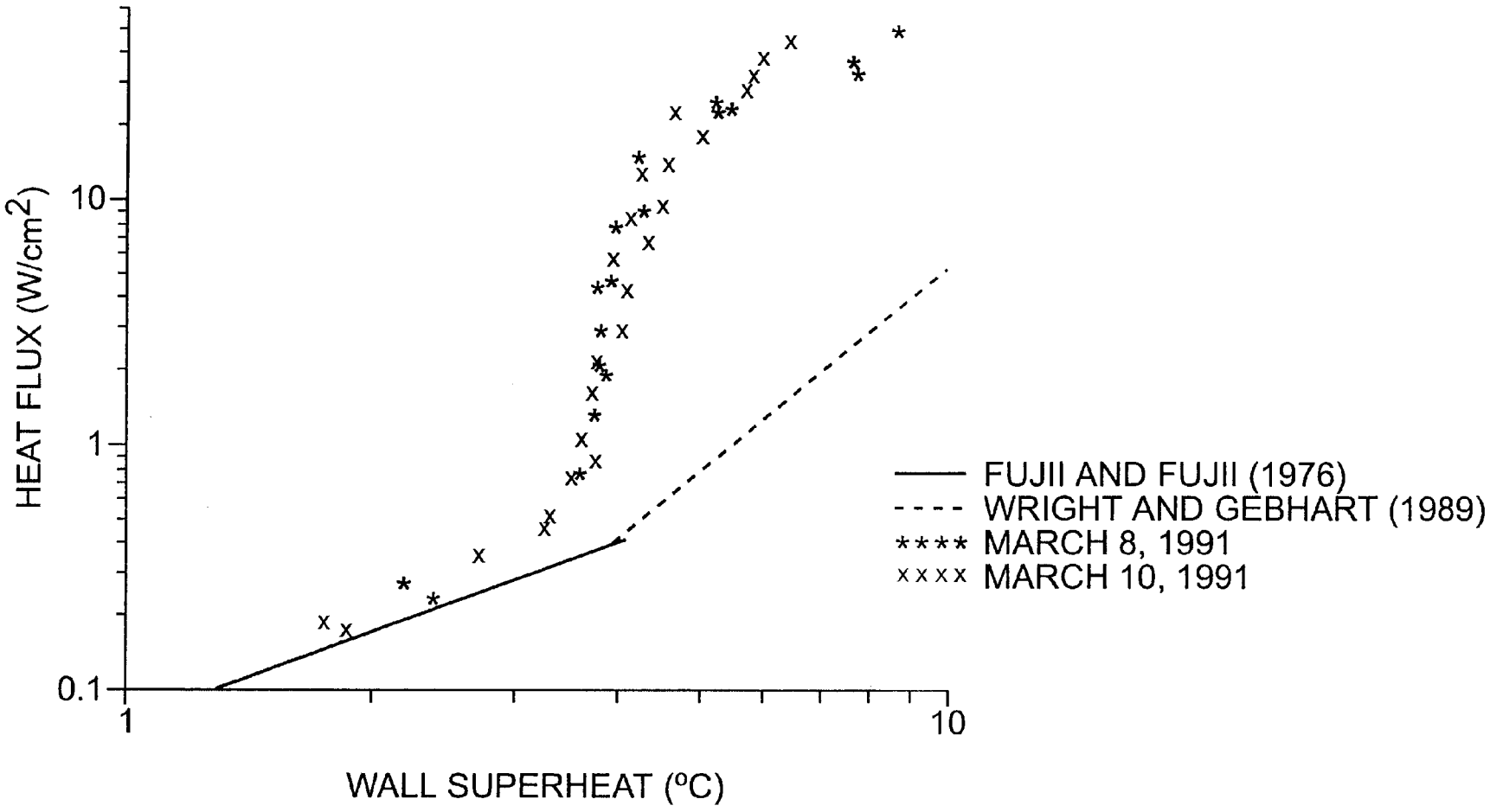
FIG. 10: is a graph depicting heat flux versus wall-superheat data for two separate boiling experiments, two days apart, for 10 μm inverted pyramids on 40 μm centers in water. Also included are the smooth surface data of Wright and Gebhart (1989), the Korner and Photiadis (1977) enhanced surface data, and the Fujii and Fujii (1976) natural convention correlation.

Heat flux versus wall-superheat data in water, for the 10 μm inverted pyramid surface on 40 μm centers, are shown in FIG. 10. Also included on this graph are the natural convection correlation, see Fujii, T., and Fujii, M., 1976, "The Dependence of the Local Nusselt Number on Prandtl Number in the Case of Free Convention along a Vertical Surface with Uniform Heat Flux," *International Journal of Heat and Mass Transfer*, Vol. 19, pp. 121–122, (hereinafter "Fujii and Fujii (1976)"), and the mirror polished smooth specimen data, see Wright, N., and Gebhart, B., 1989, "Enhanced Boiling on Microconfigured Surfaces, " *Transactions of the ASME, Journal of Electronics Packaging*, Vol. 111, pp. 112–120, (hereinafter "Wright and Gebhart (1989"), both of said references are hereby incorporated by reference.

The boiling heat transfer on the microconfigured surface, at wall-superheats greater than 4° C., is approximately 20 times that for the mirror polished surface data of Wright and Gebhart (1989). The initiation of boiling was observed at a wall-superheat of 3.6° C. At this wall-superheat an appreciable number of nucleation sites were seen to be active. Visualization was used throughout all water and FC-72 tests to determine the initiation of boiling. The heat transfer data was reproducible over time. Little or no hysteresis in the boiling curve was measured. A flux of 52 W/cm$^2$ was dissipated at a wall-superheat of 8.5° C.

There are two trends in the nucleate boiling region. The region from 3.3 to 4.6° C. is almost vertical from q"=0.4 W/cm$^2$ to 10 W/cm$^2$. A second trend of much lower slope followed, from q"=10 W/cm$^2$ to 50 W/cm$^2$.

When a bubble departs a typical engineered surface, liquid at ambient temperature may flood the region surrounding the nucleation site. This process maintains the surface temperature at a constant value. The sites of this invention are spaced far enough apart that the flooding process is independent of adjacent bubbles. That is, the departing bubbles preferably do not touch or affect the wake of neighboring bubbles.

Figure 11:
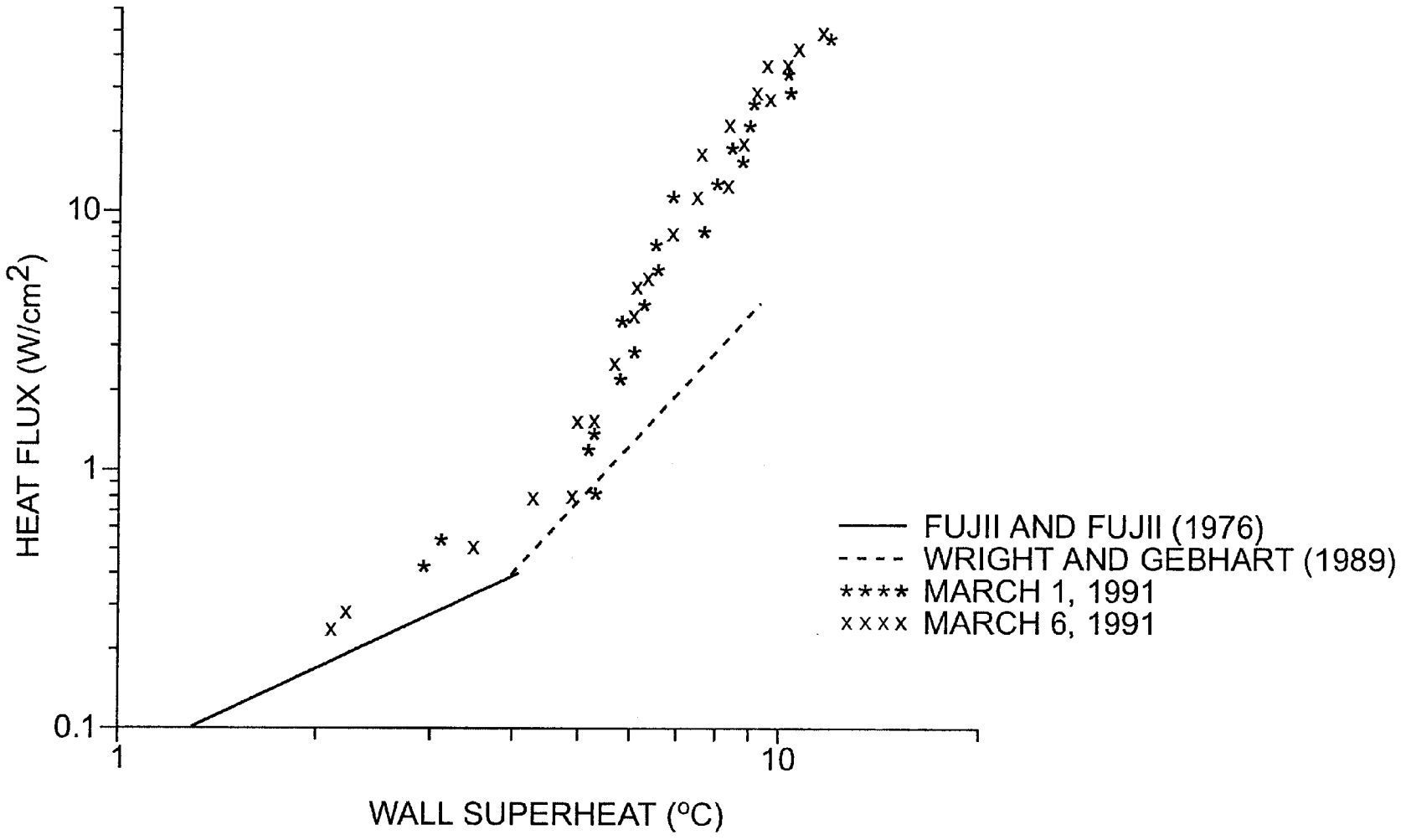
FIG. 11: is a graph depicting heat flux versus wall-superheat data for two separate boiling experiments five days apart, for loam inverted pyramids on 60 μm centers in water. Also included are the smooth surface data of Wright and Gebhart (1989), the Korner and Photiadis (1977) enhanced surface data, and the Fujii and Fujii (1976) natural convention correlation.

FIG. 11 shows the heat flux versus wall-superheat data for the 10 μm inverted pyramid surface, at the largest center spacing, of 60 μm, in water. The initiation of boiling was observed to occur at a wall-superheat of about 5.0° C. This data is also reproducible over time. The two regions of the boiling curve found at 40 μm center spacings are not as distant as at 60 μm center spacings. The boiling heat transfer enhancement of this 60 μm center spacing surface, over the mirror polished surface data of Wright and Gebhart (1989), is about a factor of 6. No temperature hysteresis arose at boiling initiation.

Figure 12:
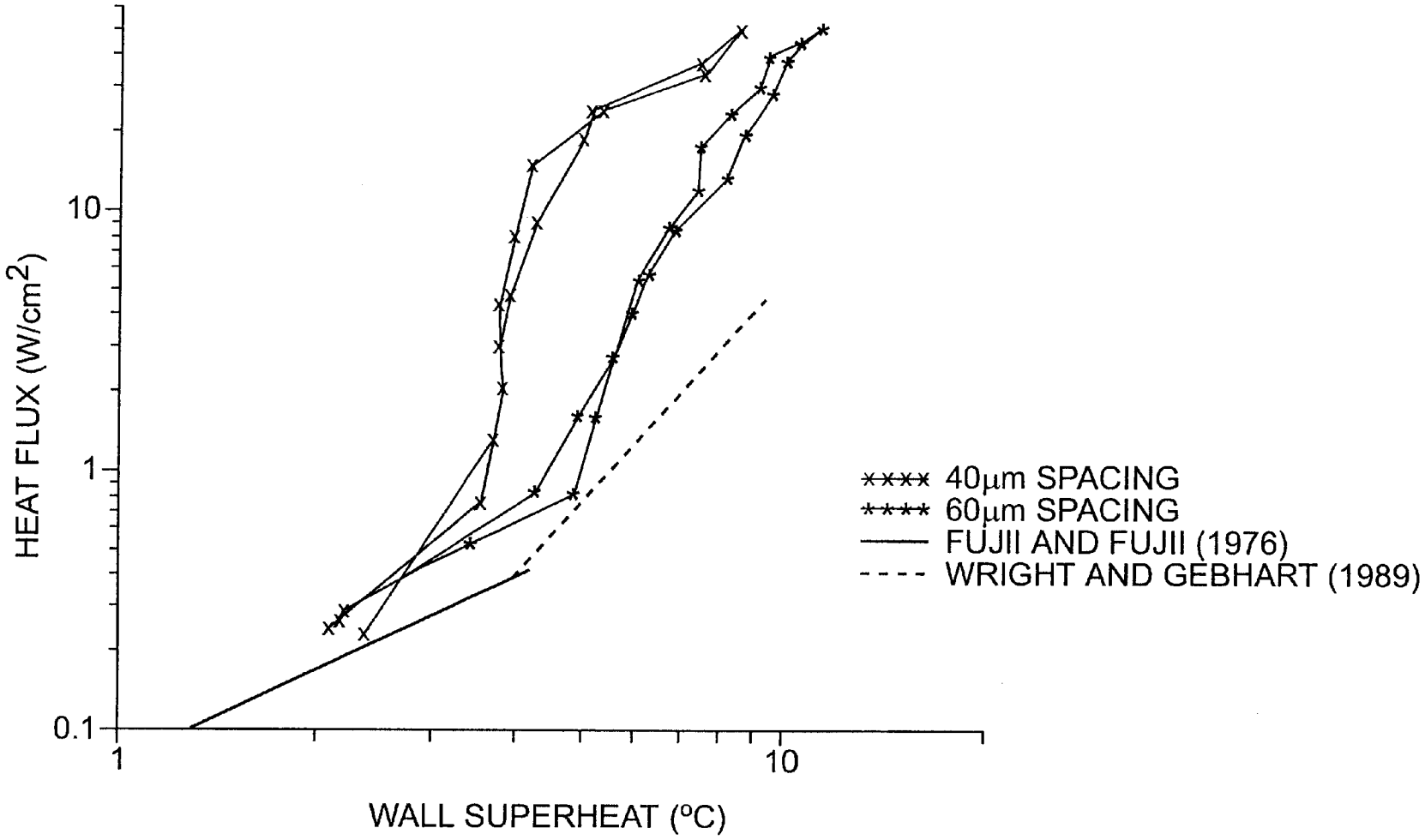
FIG. 12: is a graph depicting a comparison of boiling heat flux versus wall-superheat data for 10 μm inverted pyramids with 40 and 60 μm spacing in water. Also included are the smooth surface data from Wright and Gebhart (1989), and the Fujii and Fujii (1976) natural convention correlation.

FIG. 12 compares the foregoing data from the two loam inverted pyramid surfaces with 40 and 60 μm centers. The Fujii and Fujii (1976) natural convection correlation and the mirror polished surface data of Wright and Gebhart (1989) are also shown. The spacing of the microconfigurations is seen to have a very large effect on both the location of the boiling curve and the value of the wall-superheat at boiling initiation. For example, the 40 μm spacing surface dissipates the same heat flux as the 60 μm spacing surface at only 60% of the wall-superheat. The wall-superheat at the observed initiation of boiling at 40 μm center spacing is 67% of the 60 μm center spacing.

Figure 13:
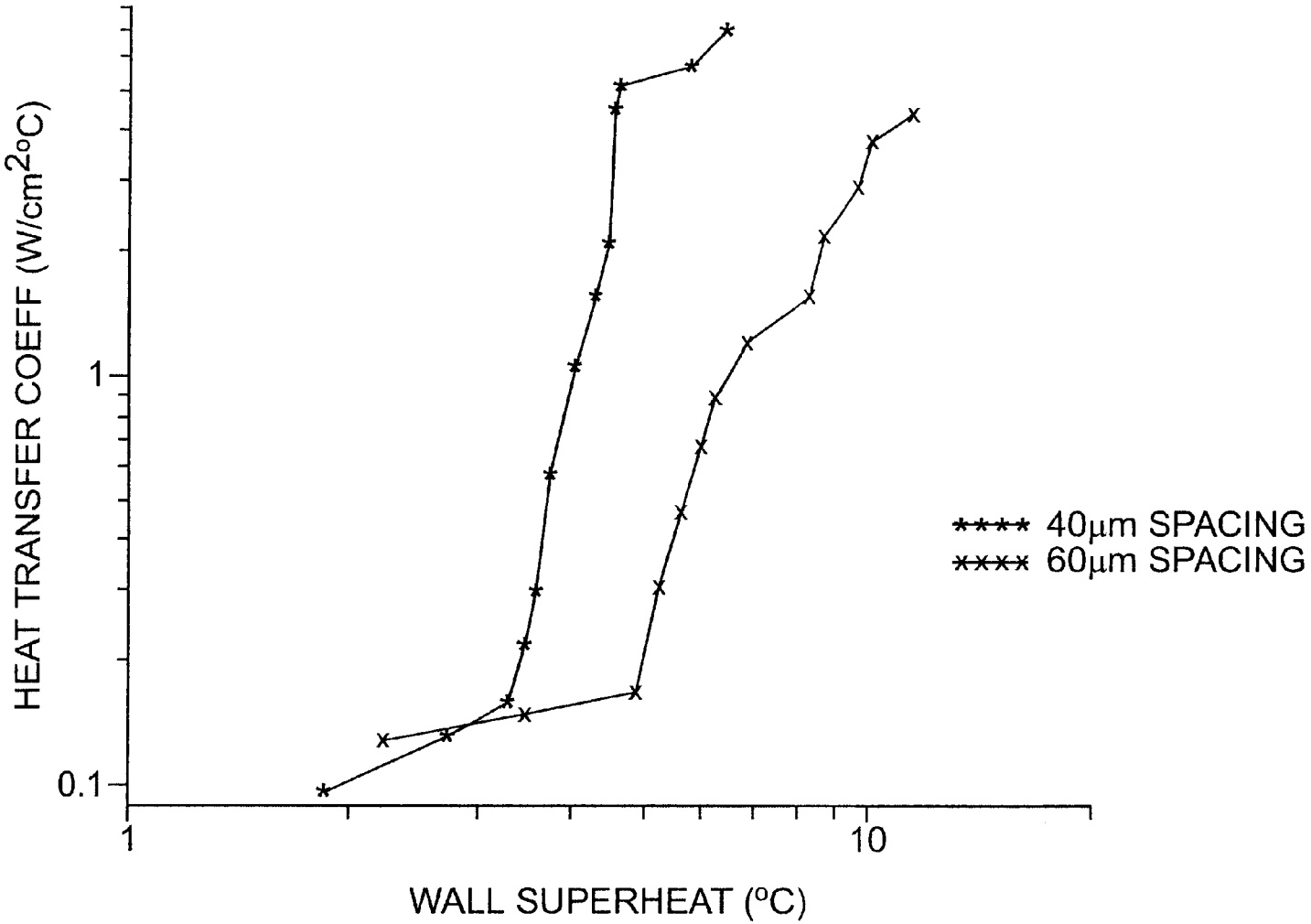
FIG. 13: is a graph depicting a comparison of boiling heat transfer coefficient versus wall-superheat data for the 10 μm inverted pyramids with 40 and 60 μm spacing in water.

FIG. 13 compares the heat transfer coefficient as a function of wall-superheat for the 10 μm inverted pyramid surfaces with 40 and 60 μm center spacings. The initiation of boiling, at wall-superheats of 3.6 and 5.3° C., for the 40 and 60 μm center spacings, is very distinct. The slope of the heat transfer coefficient trend changes. The highest value of the heat transfer coefficient for the 40 μm center spacing surface, at a heat flux of 46.2 W/cm$^2$, is 7.16 W/cm$^{2\circ}$ C. (12600BTU/hrft$^{2\circ}$ F.). The highest value for the larger spacing surface, at a heat flux of 50 W/cm$^2$, 4.46 W/cm$^{2\circ}$ C. (7850BTU/hr ft$^{2\circ}$ F.).

Figure 14:
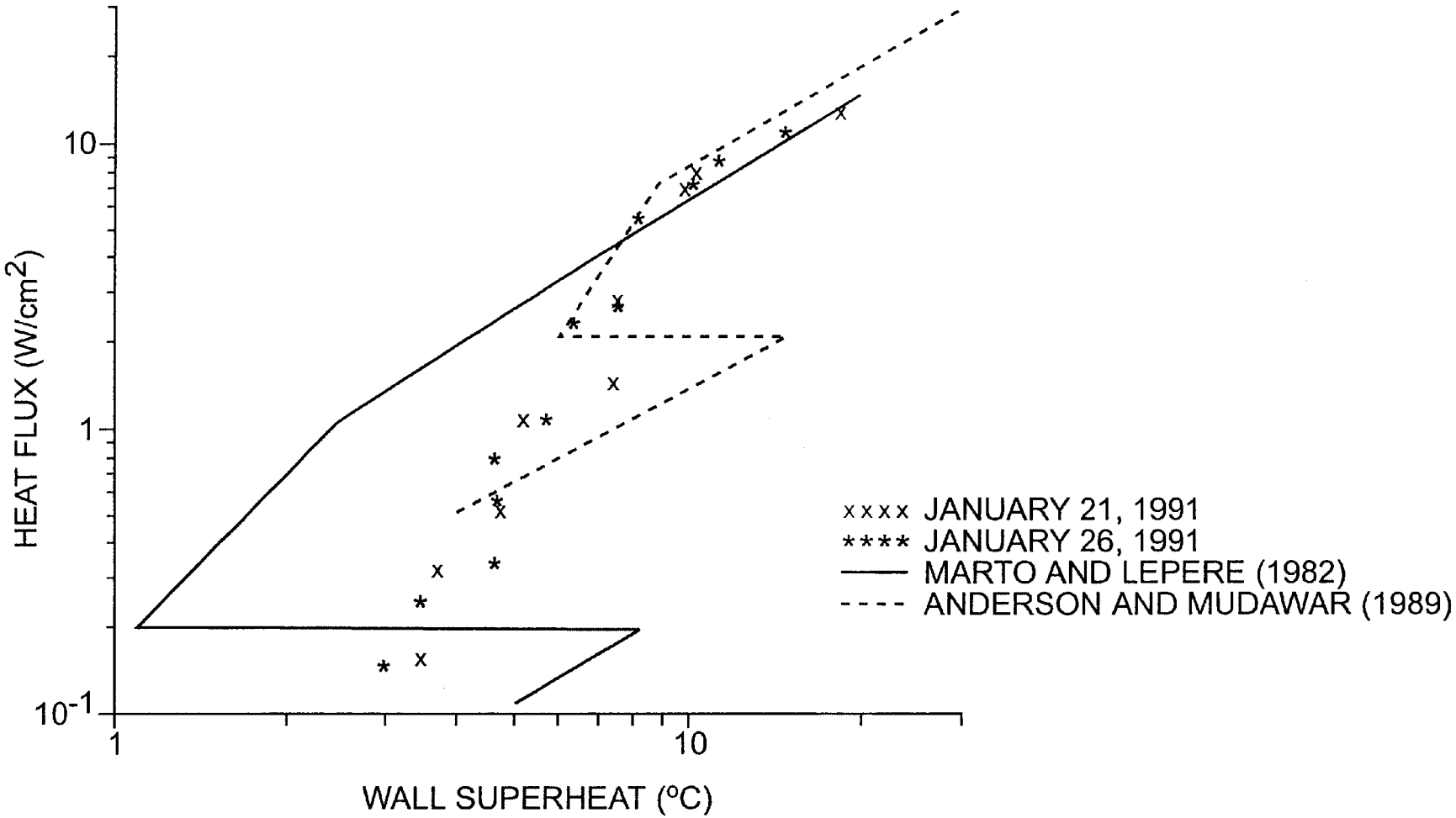
FIG. 14: is a graph depicting heat flux versus wall-superheat data for two separate experiments five days apart for 10 μm inverted pyramids at 20 μm spacing, in FC-72. Also included for comparison are data from Anderson and Mudawar (1989) and Marto and Lepere (1982), also in FC-72.
Figure 15:
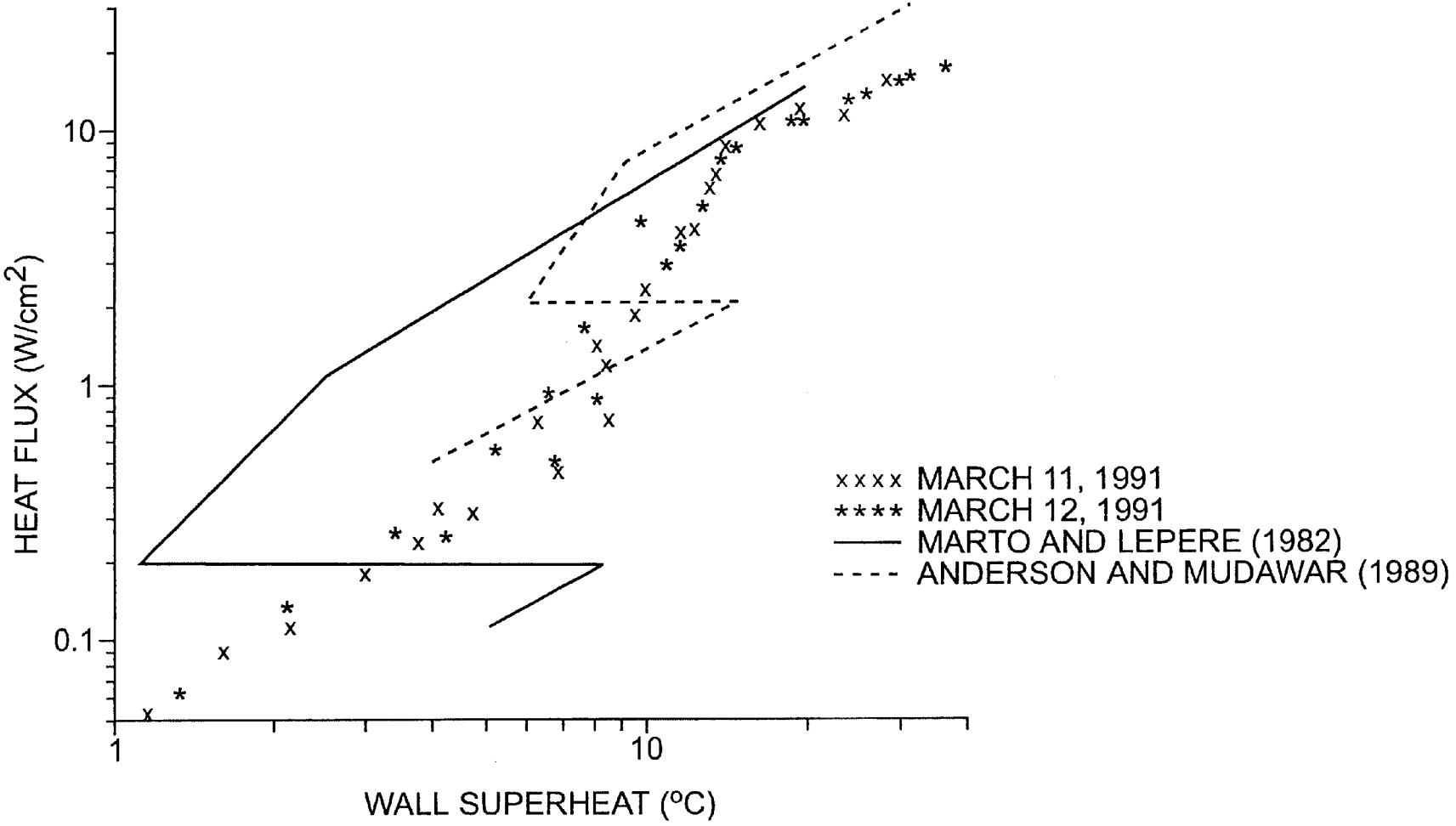
FIG. 15: is a graph depicting heat flux versus wall-superheat data for two separate experiments, one day apart, for 10 μm inverted pyramids with 40 μm center spacing, in FC-72. The results of Anderson and Mudawar (1989) and Marto and Lepere (1982) are included.

Heat flux versus wall-superheat data are shown in FIGS. 14, 15, and 16 for the three 10 μm inverted pyramid microconfigured surfaces, with 20, 40, and 60 μm center spacings, respectively. Also shown for comparison are the performances of the Thermoexcel-E surface coating described in Marto, P. J., and Lepere, V. J., 1982, "Pool Boiling Heat Transfer from Enhanced Surfaces to Dielectric Fluids," ASME, *Journal of Heat Transfer*, Vol. 104, pp. 292–299, (hereinafter "Marto and Lepere (1982)"), and the microstud surface described in Anderson, T. M., and Mudawar, I., 1989, "Microelectronic Cooling by Enhanced Pool Boiling of a Dielectric Fluorocarbon Liquid", ASME, *Journal of Heat Transfer*, Vol. 111, pp. 752–759, (hereinafter "Anderson and Mudawar (1989)"), both of said references are hereby incorporated by reference. The Marto and Lepere (1982) data is for a 16.5 mm OD tube with a Thermoexcel-E coating on the outside. The coating provides re-entrant cavities with an approximate mouth diameter of 0.1 mm. The area enhancement is not given. The Anderson and Mudawar (1989) boiling data was for a surface with 0.305 mm, square cross-section, studs protruding 0.610 mm from the base surface. The area enhancement of the microstud surface was 1.66 times the base area. The data shown here for the three microconfigured surfaces is highly reproducible over time.

The wall-superheat at boiling initiation, the wall-superheat reversal in trend, and the temperature hysteresis of each of the three microconfigured surfaces are also independent of pre-boiling history. The "wall-superheat reversal in trend" is defined here, and shown in FIG. 16, as the maximum decrease in wall-superheat, with increasing heat flux, on the first ascent of the boiling curve. Generally, the wall-superheat reversal in trend is the hysteresis in the boiling curve. "Hysteresis" is commonly understood to be defined, and shown in FIG. 16, as the excess wall-superheat necessary to activate nucleation sites on the first ascent of the boiling curve, minus the wall-superheat on the first descent of the boiling curve. Explosive nucleation or "temperature overshoot" is defined as the sudden drop in wall superheat at constant heat flux during the initial ascent of the nucleate boiling curve, as shown by the Marto and Lepere (1982) and Anderson and Mudawar (1989) curves in FIG. 16. Large temperature overshoots have been known to thermally shock and damage delicate semi-conductor substrates.

The microconfigured surface boiling performance spans from about 3 to 20° C., over a heat flux range from 0.14 to 13 W/cm$^2$. This is a smaller range of wall-superheats than the Thermoexcel-E and microstud surfaces. A large hysteresis and wall-superheat reversal in trend arose in the comparison measurements of these other surfaces at the onset of boiling. These observations may be attributed to the large wall-superheat needed to initiate the boiling process on the first ascent of the boiling curve, with flooded cavities. Once boiling arises locally, it apparently rapidly spreads to the entire surface. The surface temperature then drops suddenly at constant heat flux as shown in FIG. 16. In the comparison measurements of the Thermoexcel-E and microstud surfaces, the reversal in trend equals the temperature hysteresis. Once the sites are activated, a smaller temperature difference is necessary to maintain nucleation at a given flux.

Such explosive nucleation and large temperature overshoot did not occur in any of our experiments with microconfigured surfaces of this invention. Instead, nucleation begins at several apparently random active sites on the surface. The number of active sites increases with increasing heat flux. The result is that the boiling curve becomes vertical or undergoes a small wall-superheat reversal of trend with increasing heat flux. It does not suddenly revert to large scale nucleation, with a resulting rapid decrease of the wall temperature. The wall-superheat reversal of trend was always very much less than the temperature hysteresis seen in earlier experiments. Our measurements indicate that large temperature-caused transient thermal stresses do not arise with these microconfigured surfaces. There is only a reversal in upward trend, as shown by the connected points on FIGS. 14, 15, and 16.

Table 1 lists the wall-superheat at boiling initiation, the temperature hysteresis, and the reversal of trend for the three 10 μm inverted pyramid surface spacings. Also included are the results for the 9.4 μm hexagonal dimple microconfigured surface, along with the results of Marto and Lepere (1982) and Anderson and Mudawar (1989).

TABLE 1

| | FC-72 Comparison | | |
|---|---|---|---|
| Description of Surface | Observed Incipient Superheat (° C.) | Measured Temperature Hysteresis (° C.) | Measured Reversal of Trend (° C.) |
| Microconfigured 10 μm pyramid (20 μm spacing) | 4.8 | 0.9 | 0.0 |
| Microconfigured 10 μm pyramid (40 μm spacing) | 8.7 | 1.4 | 0.0 |
| Microconfigured 10 μm) pyramid (60 μm spacing) | 9.5 | 3.0 | 0.7 |
| Microconfigured 9.4 μm hex dimple (18.8 μm spacing) | 12.0 | 3.4 | 1.8 |
| Marto and Lepere (1982) Thermoexcel-E | 8.5 | 7.4 | 7.4 |
| Anderson and Mudawar (1989) Microstud | 14.7 | 8.6 | 8.6 |

The temperature "hysteresis" of the 20 μm spacing microconfigured surface was 0.9° C., compared to 7.4° C. and 8.6° C. for the Thermoexcel-E and the microstud surfaces respectively. The results for the 10 μm pyramids, 0.9, 1.4, and 3.0° C., indicate an almost linear dependence of this temperature reversal effect and wall-superheat at boiling initiation, on microconfiguration site spacing. Both the wall-superheat at initiation, as well as the small reversal effect, are less for closer site spacing.

There was no reversal of trend for the 20 and 40 μm center spacing surfaces. That is, the wall-superheat always increased with increasing heat flux on the first ascent of the boiling curve. This had not been observed with the 9.4 μm hexagonal dimple specimens, even at similar spacing and site densities, indicating that the change in aspect ratio and depth from 3.3 μm (aspect ratio "h/d" of 0.35) to 7.0 μm (aspect ratio of 0.71) was significant. The reversal of trend for all microconfigured surfaces was very much less than the observed temperature hysteresis.

Figure 17:
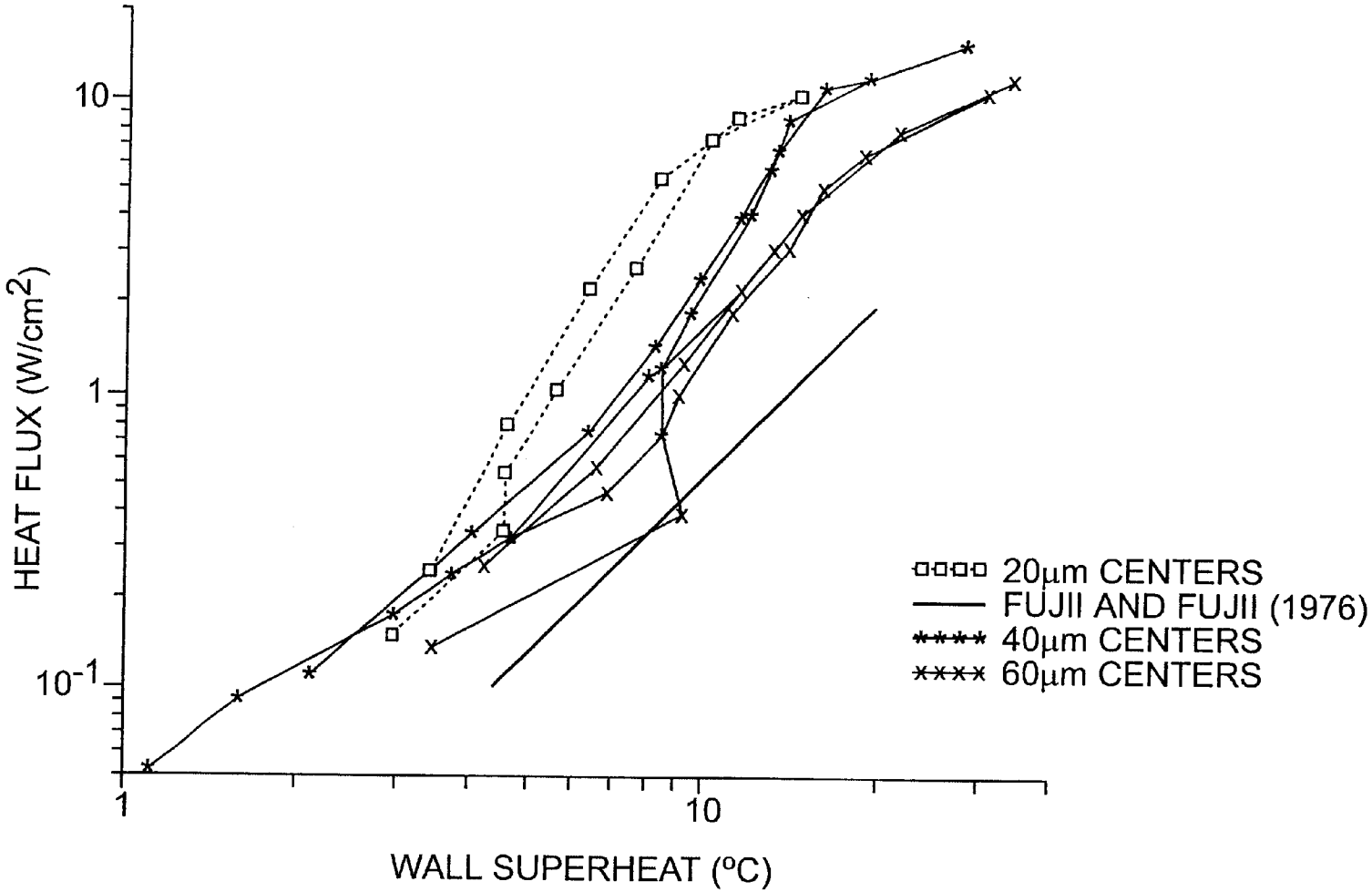
FIG. 17: is a graph depicting a comparison of heat flux versus wall-superheat data, for 10 μm inverted pyramids on 20, 40, and 60 μm centers in FC-72. The natural convection correlation of Fujii and Fujii (1976) is also shown.

FIG. 17 collects the performance characteristics from 10 μm inverted pyramid surfaces, at 20, 40, and 60 μm center spacing. The constant heat flux natural convection correlation of Fujii and Fujii (1976) is again shown. The level of the wall-superheat at a given heat flux is strongly dependent on site spacing. As the site spacing decreases from 60 μm to 20 μm the boiling curve shifts to a higher performance. The same heat flux is dissipated at 20 μm spacing surface at 50% of the wall-superheat required for 60 μm spacing.

Figure 18:
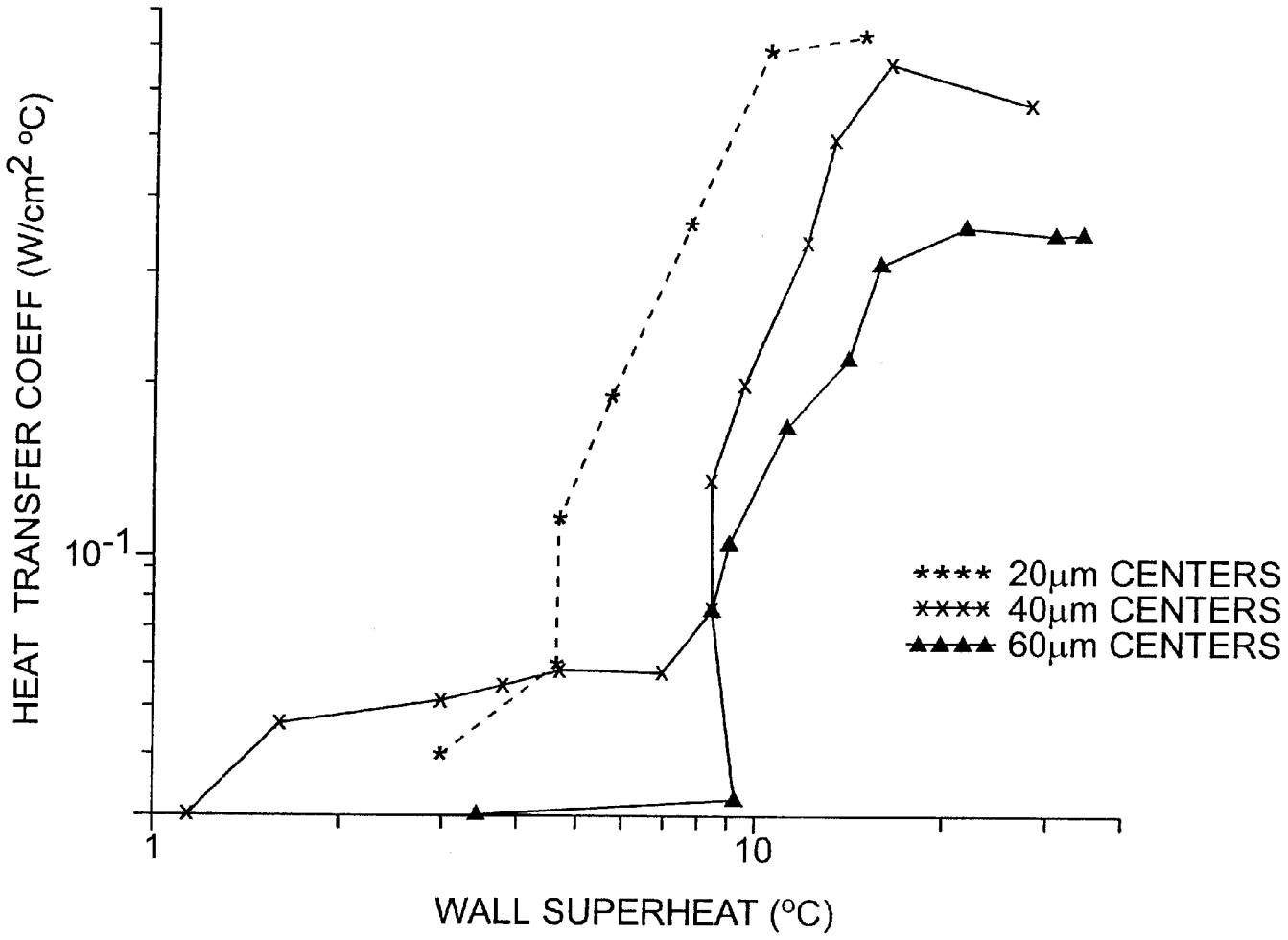
FIG. 18: is a graph depicting a comparison of heat transfer coefficient versus wall-superheat data, for 10 μm inverted pyramids with 20, 40, and 60 μm center spacing in FC-72.

FIG. 18 compares the heat transfer coefficient versus wall-superheat performance of the 10 μm inverted pyramid surfaces, at center spacings of 20, 40, and 60 μm . The initiation of boiling is distinguished by the sharp increase in slope at 4.8, 8.7, and 9.5° C. for the 20, 40, and 60 μm center spacings, respectively. The peak heat transfer coefficient in FC-72 occurs on the 20 μm surface at a heat flux of 10.8 W/cm$^2$. It is 0.73 W/cm$^{2\circ}$ C. or 1280BTU/hrft$^{2\circ}$ F.

Figure 19:
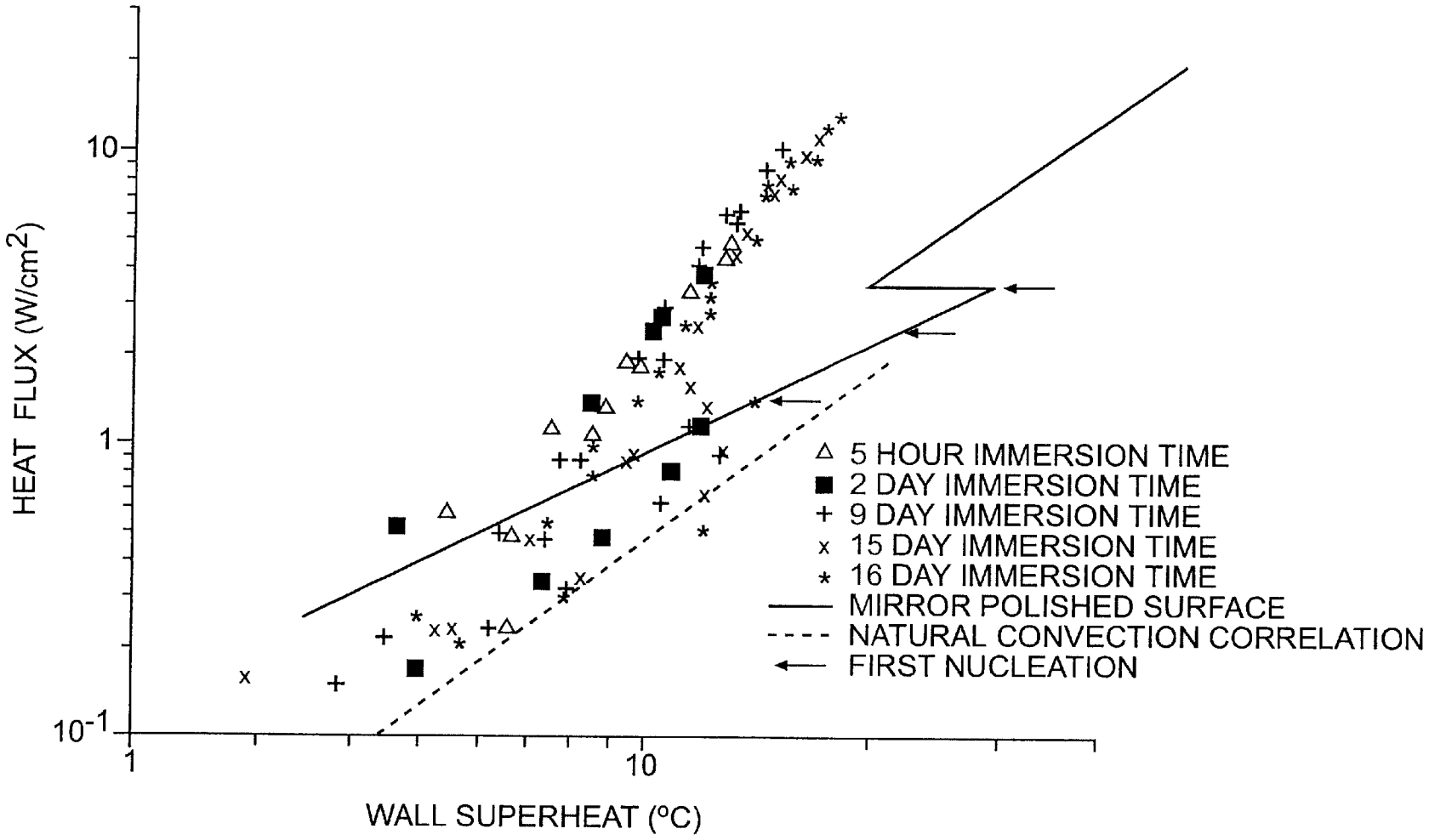
FIG. 19: is a graph depicting heat flux versus wall-superheat for the 9.4 μm hexagonal dimple surface, in FC-72. The results are for five immersion times spanning 16 days. Also shown are the mirror polished surface data of Anderson and Mudawar (1989)

FIG. 19 shows the heat flux-superheat measurements in FC-72 by Miller, et al. (1990) for 9.4 μm hexagonal dimples of 3.3 μm depth, at 18 μm center spacing. See the preceding table. Also shown is the performance of the mirror polished surface of Anderson and Mudawar (1989). The wall-superheat, temperature overshoot at boiling initiation, and the reversal of trend for the microconfigured surface, are independent of the non-boiling immersion time. That is, the measurements are reproducible even after the surface has been immersed in the dielectric liquid for a long period of time. Anderson and Mudawar (1989) had found that the required wall-superheat at boiling initiation increased by 15° C. over a 64 hour period, for the mirror polished surface.

Figure 20:
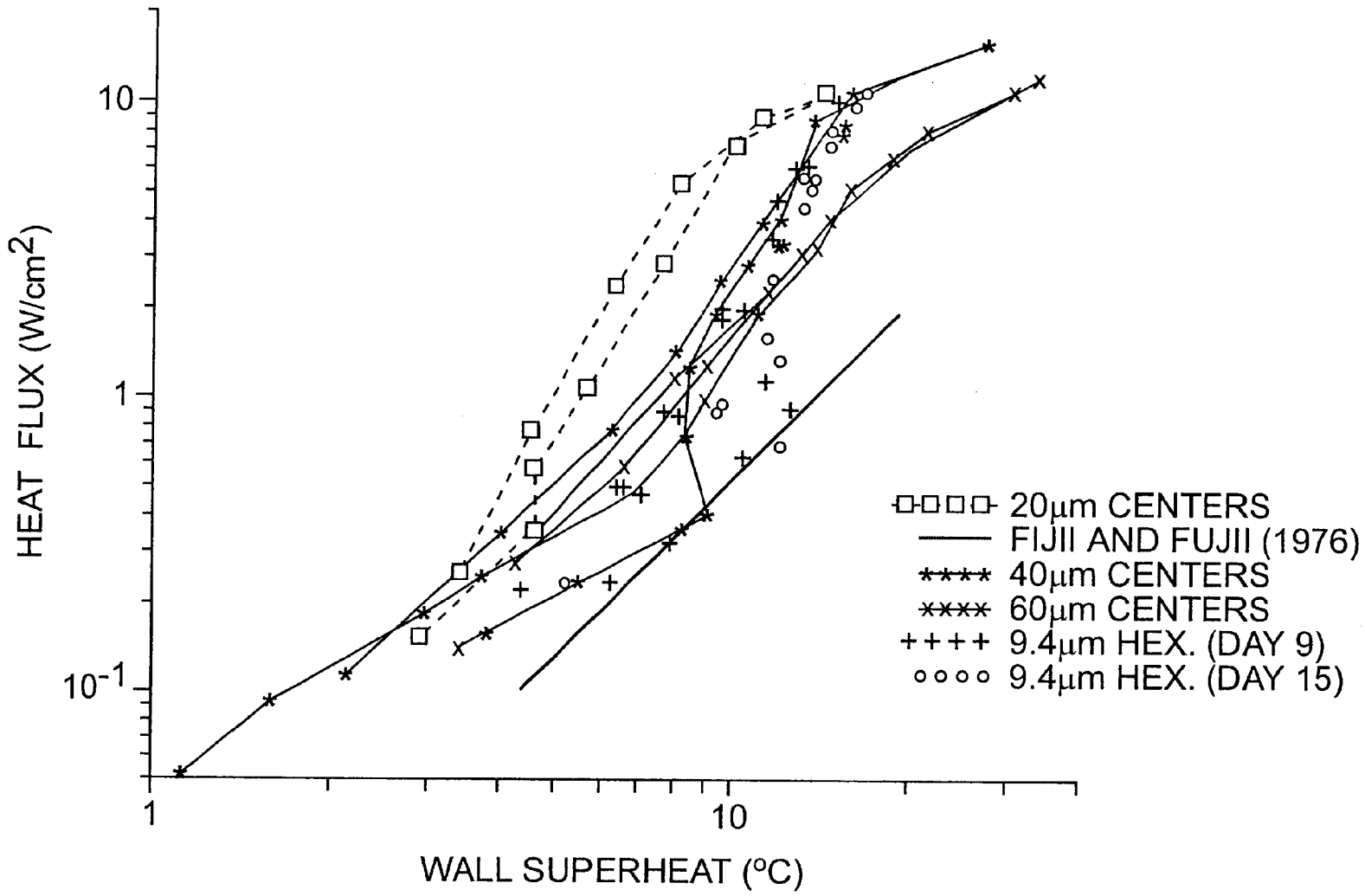
FIG. 20: is a graph depicting a comparison of heat flux versus wall-superheat data for the 9.4 μm hexagonal dimple surface and for the loam inverted pyramids on 20, 40, and 60 μm centers, in FC-72.

FIG. 20 compares the data for 10 μm inverted pyramids on 20, 40, and 60 μm centers, with that for the 9.4 μm hexagonal dimple specimen on 18.8 μm centers. The data at low superheat are about the same for the 9.4 μm hexagonal dimple surface and the 10 μm inverted pyramid data. After appreciable boiling is seen to begin, the 9.4 μm hexagonal dimple surface data lie close to the data of the 40 μm spacing inverted pyramid surface. The geometry of the microconfigurations, themselves, has a large effect on the location of the nucleate boiling curve. The depth of the hexagonal dimples is 46% of the depth of the inverted pyramids. This strongly suggests that the depth and the aspect ratio, are important in determining the incipient wall-superheat. That is, both cavity geometry and site spacing are important in minimizing or eliminating hysteresis, temperature overshoot and reversal of trend determining the wall-superheat level necessary to dissipate a given heat flux. It is also important to understand that the stable retention of vapor embryos for the microconfigured surfaces of this invention was not consistent with the criterion for the stability of a nucleation site, in Equation 1, since the cone angle of the site on the microconfigured surfaces was much greater than the contact angle in FC-72. One possible explanation for this anomaly may be that the nucleation sites on the microconfigured surfaces were about 10–100 times smaller than other nucleation site configurations tested previously. At this small scale, the retention and stability of vapor embryos in a cavity is effected by other stability considerations.

Figure 21:
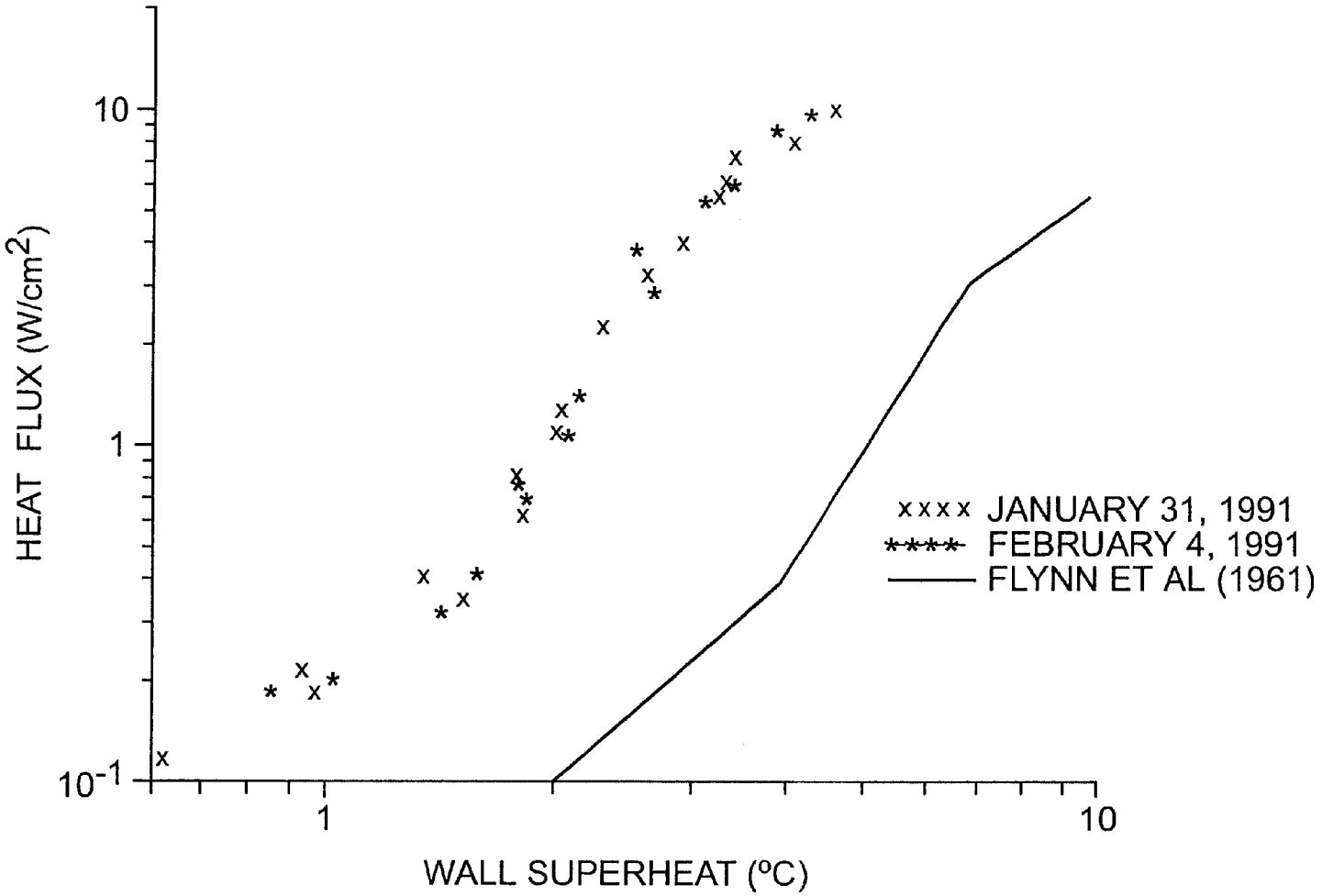
FIG. 21: is a graph depicting a comparison of heat flux versus wall-superheat data for two separate experiments over four days for 10 μm inverted pyramids with 20 μm spacing in liquid nitrogen. Also included are the data trends given by Flynn et al. (1961)
Figure 22:
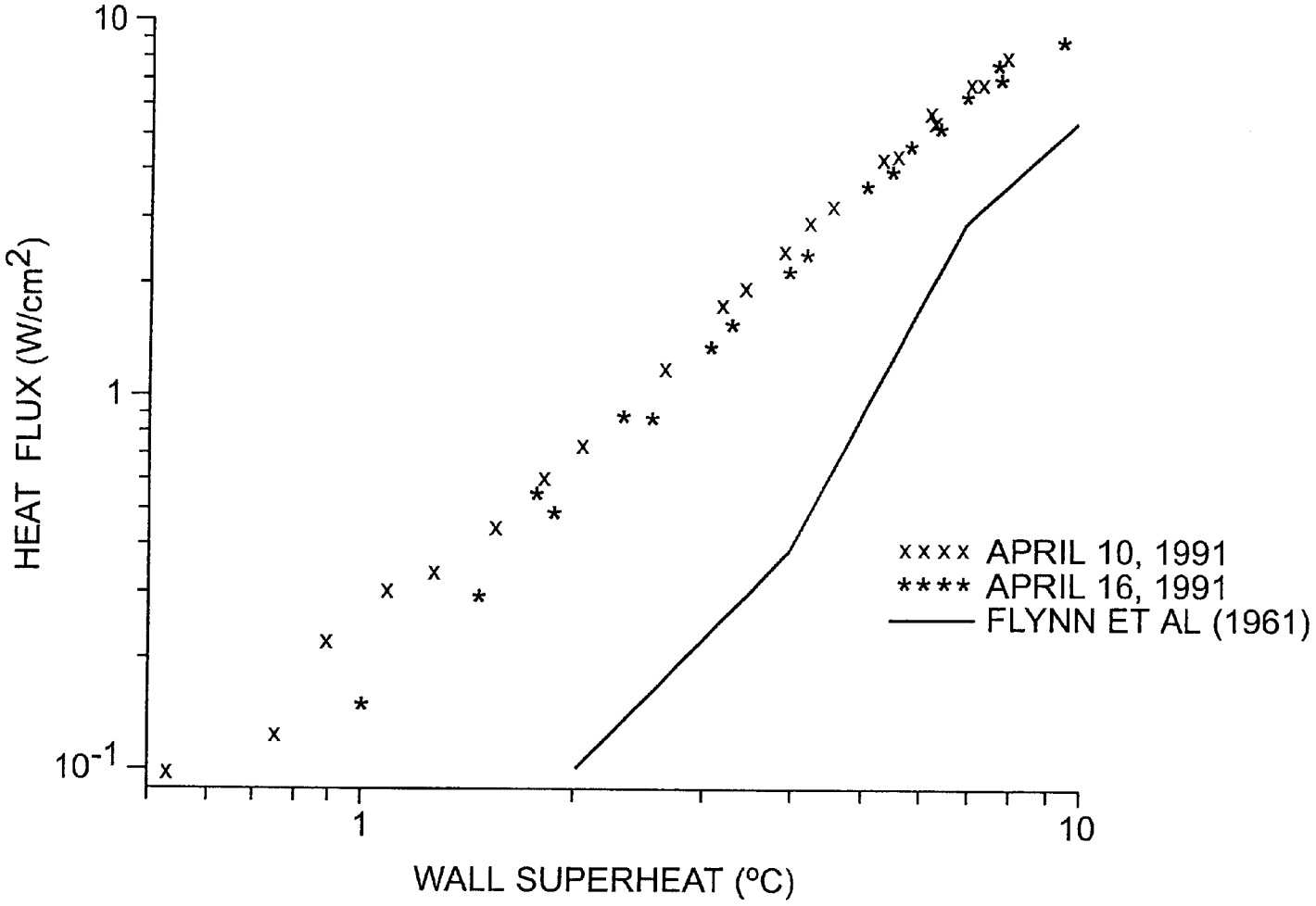
FIG. 22: is a graph depicting a comparison of heat flux versus wall-superheat data for two separate experiments, six days apart for 10 μm inverted pyramids with 40 μm spacing, in liquid nitrogen. Also included are the data trends given by Flynn et al. (1961)
Figure 23:
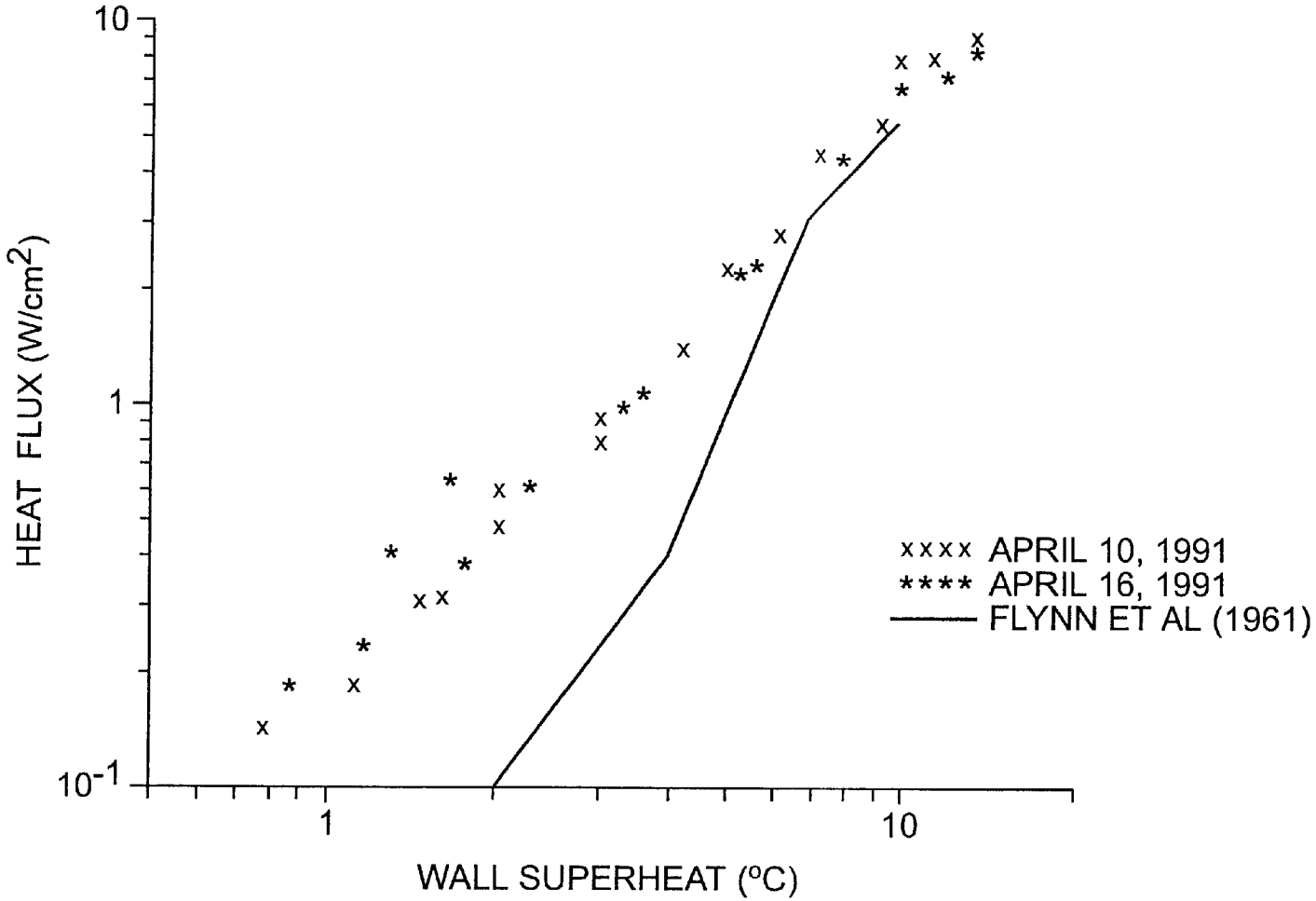
FIG. 23: is a graph depicting a comparison of heat flux versus wall-superheat data for two separate experiments, two days apart for 10 μm inverted pyramids with 60 μm spacing, in liquid nitrogen. Also included are the data trends given by Flynn et al. (1961)

FIGS. 21, 22, and 23 show heat flux versus wall-superheat data for the 10 $\mu$m inverted pyramid surface with 20, 40, and 60 $\mu$m center spacings, in liquid nitrogen. Also included, are the data of Flynn, T. M., Draper, J. W., and Roos, J. J., 1961, "The Nucleate and Film Boiling Curve of Liquid Nitrogen at One Atmosphere", *Advances in Cryogenic Engineering*, Vol. 7, pp. 539–545, (herein, "Flynn, et al. (1961)"), and hereby incorporated by reference. Flynn et al. used a copper tube, 1.59 cm OD, without any particular preparation of the boiling surface.

The results shown for all three feature spacings were each repeatable over time, as were the water and FC-72 results discussed earlier. No temperature hysteresis arose in the boiling curves for $LN_2$ and all three microconfigured surface spacings indicated enhancement over data of the Flynn, et al. (1961). As with the other liquids, the surface with 20 $\mu$m feature spacing showed the largest enhancement in $LN_2$ approaching 30 times. The 60 $\mu$m spacing surface showed the smallest average enhancement, only 40% above the data of the comparison surface. The shape of the boiling curve, for all three feature spacings, is similar to the shape of the boiling curve of the comparison surface. Stable nucleation was begun on the 20 $\mu$m surface at 10 W/cm$^2$ at a wall-superheat of only 4.5° C. It was not possible to observe the heat transfer surface during the $LN_2$ tests. Therefore, the wall-superheat at which boiling began is not known.

Figure 24:
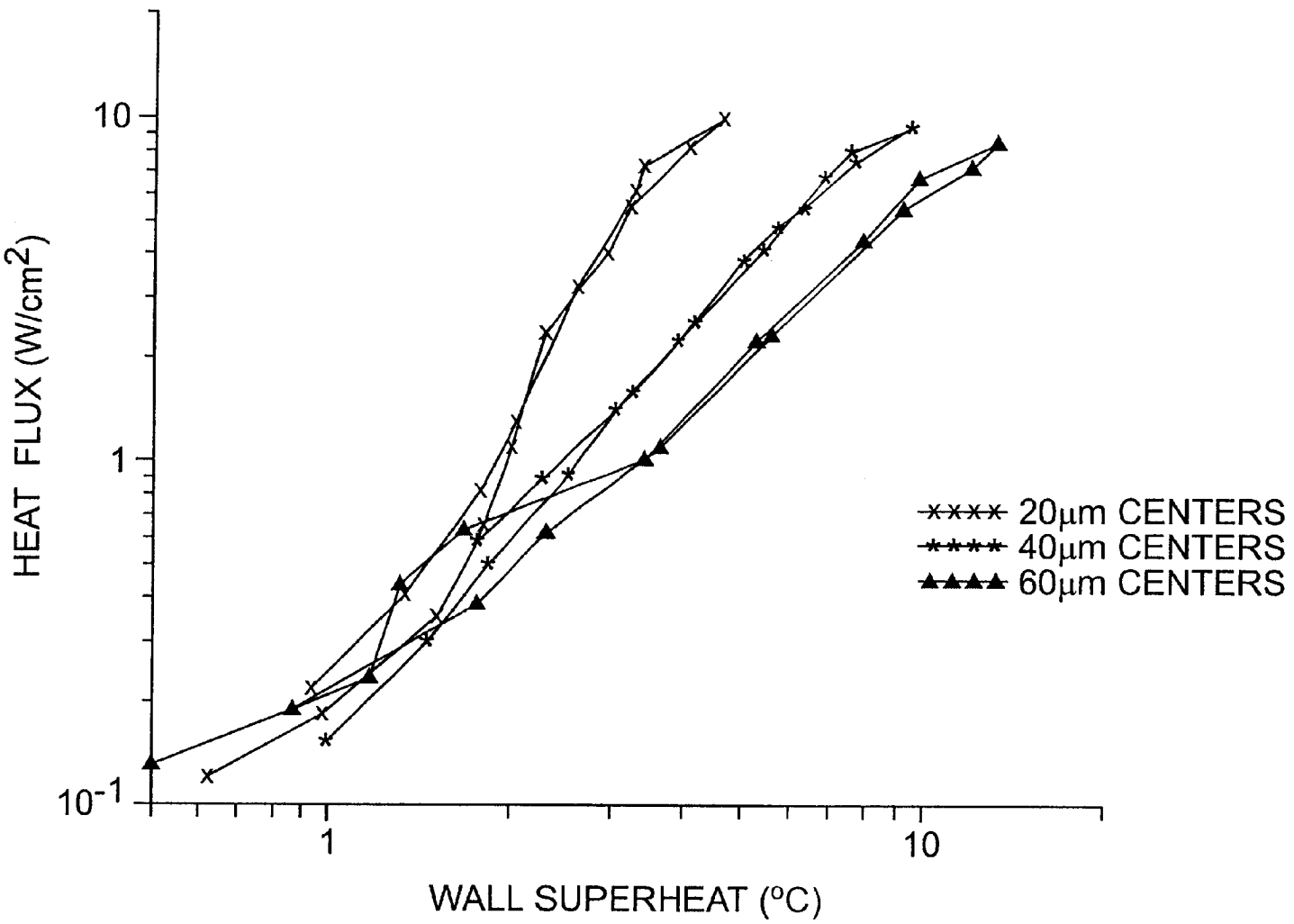
FIG. 24: is a graph depicting a comparison of heat flux versus wall-superheat data for loam inverted pyramids with 20, 40, and 60 $\mu$m spacing, in liquid nitrogen.

FIG. 24 collects the data from the three test surfaces in $LN_2$, 10 $\mu$m inverted pyramids at 20, 40, and 60 $\mu$m site spacing. At low wall-superheats, the data of the three surfaces are in good agreement. After boiling begins, the three curves diverge rapidly with increasing wall-superheat. This behavior is similar to that in both water and FC-72. Here, the wall-superheat needed to dissipate 8 W/cm$^2$ is 3.5, 7.7, and 11.4° C. for the 20, 40, and 60 $\mu$m center spacing surface respectively. This corresponds to an increase in wall-superheat of 325% from the smallest to largest center spacing surface.

Figure 25:
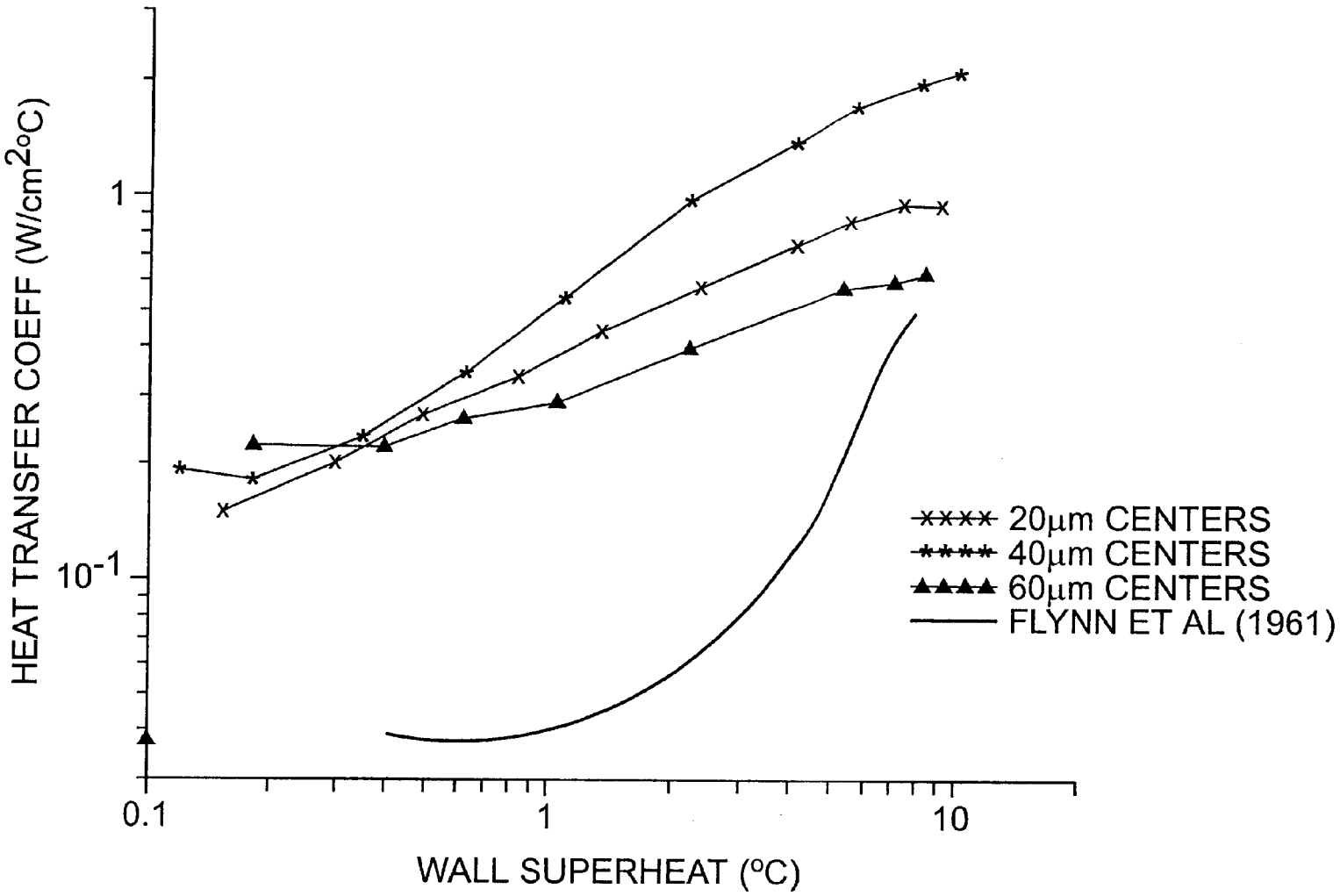
FIG. 25: is a graph depicting a comparison of the boiling heat transfer coefficient versus wall-superheat, for the 10 $\mu$m inverted pyramids with 20, 40, and 60 $\mu$m spacing in liquid nitrogen. Also included are the data trends of Flynn et al. (1961).

FIG. 25 shows the heat transfer coefficient versus wall-superheat performance of the 10 $\mu$m inverted pyramid surfaces, at center spacings of 20, 40, and 60 $\mu$m in $LN_2$. It is difficult to observe the initiation of boiling, but the wall-superheat appears to be less than 1° C. for all three surfaces. The peak heat transfer coefficient again occurs on the 20 $\mu$m center spacing surface at a heat flux of 10.1 W/cm$^2$. It is 2.13 W/cm$^{2\circ}$ C. or 3750 BTU/hrft$^{2\circ}$ F. The 20 $\mu$m and 40 $\mu$m samples were the only ones having heat transfer coefficients of about 1 W/cm$^{2\circ}$ C. or better.

From the foregoing, it will be understood that this invention provides improved methods of cooling and heat transfer systems which take advantage of precisely photo etched microconfigured surfaces. Microconfiguration site spacing strongly affects the overall boiling heat transfer performance in water, FC-72, and liquid nitrogen. The largest effect is seen in liquid nitrogen. All heat transfer data were repeatable over time, within experimental limits.

The independence of both the wall-superheat at boiling initiation and hysteresis with time is attributed to the small and precise size of each possible nucleation site. The size of the nucleation sites of this invention is believed to be about the same as the microscopic vapor embryos remaining, after the cavity had become largely flooded.

In the convective vaporization regime in water, a heat transfer enhancement of 30% of the Fujii and Fujii (1976) natural convection correlation was measured with the surfaces of this invention. The loom inverted pyramid surface with 40 $\mu$m center spacing in water dissipated 20 times the heat flux, at a given wall-superheat, than the mirror polished surface of Wright and Gebhart (1989). Two distinct regions of heat transfer apparently arose, across the superheat range, from 3.5 to 9.8° C. At low heat wall-superheats, it was observed that the number of active sites on the surface was small. They were spaced randomly on the surface, and were generally greater than 3 mm apart. At this wide spacing, enhanced fluid convection maintains the surface at almost uniform temperature, with increasing heat flux. At heat fluxes greater than 10 W/cm$^2$, the active sites are closely spaced. Enhanced convection is less effective. The forces applied by neighboring bubbles generally affects the bubble stability, departure geometry, and frequency.

In FC-72, the temperature hysteresis was less than 1° C. for the 10 $\mu$m inverted pyramid surface with 20 $\mu$m centers. A reversal of trend on the first ascent of the boiling curve was not found for the microconfigured surfaces at 20 and 40 $\mu$m center spacings. The reversal of trend on all microconfigured surfaces, as shown in FIG. 20, was very much less than the temperature hysteresis defined above. The wall-superheat at boiling initiation was independent of the non-boiling immersion time.

In liquid nitrogen, no reversal effect arose in the boiling curve. A boiling heat transfer enhancement of 30 times the performance of the copper tube data of Flynn, et al. (1961) was measured for the microconfigured surface with 20 $\mu$m feature spacing. An increase in wall-superheat of 325%, from the smallest to largest center spacing surface, was found to dissipate 8 W/cm$^2$. Heat fluxes of 10 W/cm$^2$ were measured at wall-superheats of 9.8° C. with the 20 $\mu$m surface.

The observed initiation of appreciable boiling in water and FC-72 decreased with decreasing site spacing as shown in Table 2.

TABLE 2

Wall-Superheat at the Observed Initiation of Boiling for Water and FC-72

| Description of surface | Water | FC-72 |
|---|---|---|
| Microconfigured 10 $\mu$m inverted pyramid with 20 $\mu$m center spacing (2.5 × 10$^5$/cm$^2$) | N/A | 4.8 |
| Microconfigured 10 $\mu$m inverted pyramid with 40 $\mu$m center spacing (1.1 × 10$^5$/cm$^2$) | 3.6 | 8.7 |
| Microconfigured 10 $\mu$m inverted pyramid with 60 $\mu$m center spacing (2.8 × 10$^4$/cm$^2$) | 5.3 | 9.5 |

N/A: No data for the 20 $\mu$m spacing surface in water

For a given site spacing, the wall-superheat of boiling initiation in water is less than that in FC-72. The initiation wall-superheat for the 20 $\mu$m surface in FC-72 is less than the wall-superheat in water for the 60 $\mu$m center spacing surface.

Although various process and equipment embodiments have been illustrated, this was for the purpose of describing and not limiting this invention. Various modifications, which will become apparent to one skilled in the art, are within the scope of this invention as set forth in the attached claims.

LIST OF REFERENCE NUMERALS

10 Chip
11 Module

12 Gold Film Contacts
14 Back Surface Thermocouple Locations
16 Insulated Copper Power Leads
17 Voltage Taps
18 T-Type Thermocouples
20 Felt Insert
22 Short Stainless Steel Tube
23 Cryogenic Adhesive
24 Fiberglass Insulation
26 Felt Insert
28 Cryogenic Adhesive
30 Specimen
32 RTV Silicon Adhesive/Sealant
33 Power Leads
34 Stainless Steel Sting
36 Pass-Throughs
37 Thermocouple Wires
39 Voltage Taps
42 Insulated Stainless Steel Tank
44 Vertical Immersion Heater
45 Bottom Plate
46 Thermocouples

What is claimed is:

1. A method of cooling a surface by nucleate boiling, comprising:

(a) providing a polished, photo etched surface containing a predetermined minimum surface density of discrete nucleation sites having a conical cross-section tapering to at least a minimum predetermined depth;

(b) immersing said surface in a refrigerant having a liquid contact angle of less than 5° and a preselected boiling point so that said nucleation sites become flooded by said refrigerant, wherein said conical cross-section has a cavity cone angle, $\theta$, which is greater than the liquid contact angle, $\gamma$, of said refrigerant; and (c) permitting said surface to heat up to a temperature of at least said preselected boiling point, said heating initiating nucleate boiling of said refrigerant with a reversal of trend of less than 2° C. and without a temperature overshoot on the initial ascent.

2. The method of claim 1, wherein said minimum predetermined depth is at least about 5 $\mu$m , and a portion of said sites have an aspect ratio of greater than about 0.5.

3. The method of claim 1, wherein said surface comprises a semi-conductor.

4. The method of claim 1, wherein said nucleate boiling initiates with a temperature hysteresis of less than 4.0° C.

5. The method of claim 1, wherein said nucleate boiling initiates with a temperature hysteresis of less than 2° C.

6. The method of claim 1, wherein said nucleate boiling initiates without a reversal of trend.

7. The method of claim 1, wherein said minimum predetermined depth is greater than about 3 $\mu$m and a portion of said sites have an aspect ratio greater than 0.3.

8. The method of claim 7, wherein said nucleation sites include a spacing of 60 $\mu$m.

9. The method of claim 7, wherein said nucleation sites include a spacing of 40 $\mu$m.

* * * * *